US007962054B2

(12) United States Patent
Nakazato et al.

(10) Patent No.: US 7,962,054 B2
(45) Date of Patent: Jun. 14, 2011

(54) IMAGE FORMING APPARATUS HAVING A FUNCTION OF PREDICTING DEVICE DETERIORATION BASED ON A PLURALITY OF TYPES OF OPERATION CONTROL INFORMATION

(75) Inventors: Yasushi Nakazato, Tokyo (JP); Kohji Ue, Kanagawa (JP); Osamu Satoh, Kanagawa (JP); Masahide Yamashita, Tokyo (JP); Jun Yamane, Kanagawa (JP); Hitoshi Shimizu, Kanagawa (JP); Shuji Hirai, Tokyo (JP); Takenori Oku, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 159 days.

(21) Appl. No.: 11/856,348

(22) Filed: Sep. 17, 2007

(65) Prior Publication Data

US 2008/0075476 A1 Mar. 27, 2008

(30) Foreign Application Priority Data

Sep. 22, 2006 (JP) ..... 2006-257171
Dec. 20, 2006 (JP) ..... 2006-342629

(51) Int. Cl.
*G03G 15/00* (2006.01)

(52) U.S. Cl. ..... 399/31; 399/24

(58) Field of Classification Search ..... 399/9, 15, 399/49, 301, 24, 31
See application file for complete search history.

(56) References Cited

U.S. PATENT DOCUMENTS 4,876,606 A 10/1989 Banno et al.
5,073,028 A 12/1991 Bowden et al.
5,576,811 A * 11/1996 Kobayashi et al. ..... 399/60
6,128,459 A 10/2000 Iwata et al.
6,282,396 B1 8/2001 Iwata et al.
6,470,169 B2 10/2002 Nakazato
6,693,654 B2 * 2/2004 Shinohara ..... 347/116
6,757,512 B2 6/2004 Miyawaki et al.
7,110,917 B2 9/2006 Matsuura et al.
7,203,431 B2 4/2007 Shoji et al.
7,203,452 B2 4/2007 Miyawaki et al.
2005/0152706 A1 * 7/2005 Koie et al. ..... 399/15

(Continued)

FOREIGN PATENT DOCUMENTS

JP 4-230813 8/1992

(Continued)

OTHER PUBLICATIONS

U.S. Appl. No. 12/120,702, filed May 15, 2008, Hirai.

(Continued)

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus is provided. The image forming apparatus includes an acquiring unit that acquires a plurality of types of operation control information of the image forming apparatus that indicate deterioration of a toner in the image forming apparatus or deterioration of a component of the image forming apparatus. An index value calculating unit calculates an index value indicating a state of the image forming apparatus based on the acquired operation control information. An abnormality judging unit judges whether the image forming apparatus abnormality has occurred and predicts an occurrence of a failure that requires maintenance of the image forming apparatus due to deterioration of the toner in the image forming apparatus or deterioration of the component of the image forming apparatus based on the index value.

12 Claims, 27 Drawing Sheets

U.S. PATENT DOCUMENTS

| | | | |
|---|---|---|---|
| 2005/0281596 | A1 | 12/2005 | Nakagawa et al. |
| 2005/0286916 | A1 | 12/2005 | Nakazato et al. |
| 2006/0088337 | A1 | 4/2006 | Nakazato et al. |
| 2006/0182451 | A1 | 8/2006 | Shoji et al. |
| 2006/0294252 | A1 | 12/2006 | Shoji et al. |
| 2007/0127934 | A1 | 6/2007 | Shoji et al. |

FOREIGN PATENT DOCUMENTS

| | | |
|---|---|---|
| JP | 5-100517 | 4/1993 |
| JP | 10-198110 | 7/1998 |
| JP | 2004-126774 | 4/2004 |
| JP | 2005-266380 | 9/2005 |
| JP | 2006-113150 | 4/2006 |

OTHER PUBLICATIONS

U.S. Appl. No. 12/184,734, filed Aug. 1, 2008, Nakazato, et al.

Japanese Office Action mailed on Apr. 22, 2011 issued in corresponding Japanese patent application 2006-342629.

* cited by examiner

IMAGE FORMING APPARATUS HAVING A FUNCTION OF PREDICTING DEVICE DETERIORATION BASED ON A PLURALITY OF TYPES OF OPERATION CONTROL INFORMATION

CROSS-REFERENCE TO RELATED APPLICATIONS

The present application claims priority to and incorporates by reference the entire contents of Japanese priority documents, 2006-257171 filed in Japan on Sep. 22, 2006 and 2006-342629 filed in Japan on Dec. 20, 2006.

BACKGROUND OF THE INVENTION

1. Field of the Invention

The present invention relates to an image forming apparatus, such as a copier, a printer, and a facsimile (FAX) machine.

2. Description of the Related Art

An image forming apparatus including an image carrier, such as a photoreceptor (photosensitive drum) and an intermediate transfer belt, gradually deteriorates in function and enters an abnormal state as a result of following factors. The factors are, for example: frictional wear accompanying normal operations; contamination by a harmful material, such as paper dust, from an external source; increased adhesion and loss of an external additive accompanying excessive stirring of toner as a result of an unexpected operation or the like; and contamination and degradation, as well as an accidental failure, of a cleaning unit and a charging unit. Abnormalities occurring in the image forming apparatus cause deterioration in image quality. Specifically, the abnormalities cause an annoying abnormal image with a vertical streak running along a rotation direction, a blurred image, an abnormal image with a horizontal streak running perpendicular to the rotation direction, an image with a spot-shaped blemish, an image with a "pinhole", and the like. However, ordinarily, the deterioration of the image quality, such as those described above, is controlled and operation of the image forming apparatus is continued as a result of image formation conditions being modified through image density control, color shifting control, and the like. When the deterioration of the image quality cannot be controlled through the image density control, the color shifting control, or the like, and the abnormal image is formed on a sheet of paper, a user becomes aware of the abnormality in the image forming apparatus. The user repairs the image forming apparatus by, for example, replacing a component such as the photoreceptor.

In this way, in a conventional image forming apparatus, the image forming apparatus is repaired when the deterioration of the image quality cannot be controlled through the image density control, the color shifting control, or the like, and the abnormal image is formed on the sheet of paper. Therefore, the image forming apparatus continues to form the abnormal image from when the abnormality occurs to when the repair is completed. The image forming apparatus cannot form a normal image during this time and, therefore, stops functioning. As a result, the user suffers a large amount of time loss. Furthermore, when the abnormal image is formed, the image is required to be formed again. As a result, resources (toner and paper) are wasted.

Patent applications related to various image forming apparatuses predicting or judging the abnormality, failure, and the like occurring in the image forming apparatus are being filed. For example, Japanese Patent Application Laid-open No. H5-100517 describes a device that measures an electric potential of an electrostatic latent image formed on a photoreceptor surface and predicts photoreceptor life. The electric potential of the electrostatic latent image is device operation control information.

However, a device, such as that described in Japanese Patent Application Laid-open No. H5-100517, that uses a single piece of device operation control information to predict and judge a device failure risks, for example, erroneously judging a temporary abnormal state caused by temperature variation and the like to be an end of device life or the device failure.

Inventors of the present invention are developing an image forming apparatus that can calculate a comprehensive index value taking into account various device operation control information. Based on the calculated comprehensive index value, the image forming apparatus can judge whether the image forming apparatus is in the abnormal state and predict an occurrence of the device failure. The inventors have found from experiments that failures can be predicted and judged with higher accuracy (robustly) and with few erroneous judgments, through the use of judgment and prediction methods such as this.

As a result of keen examination, the inventors have found that information acquired from position detection data includes information useful for the prediction and judgment of device abnormality and the device life. The position detection data is acquired when a detection pattern position detecting unit detects a position of a detection pattern formed on an image carrier A position detecting sensor used for detecting the position of the detection pattern, such as this, includes a light-emitting element and a light-receiving element. The light-emitting element emits light. The light-receiving element receives diffused reflection light diffused and reflected by a detection pattern image. The position detecting sensor also includes a slit component to accurately determine the position. The slit component has a slit having almost a same width as a line width of the detection pattern. The light-receiving element receives light that has passed through the slit in the slit component.

A detection signal from an ordinary detecting sensor detecting a detection pattern image is broad. On the other hand, a detection signal from the position detecting sensor in the above-described configuration is sharp. Because the position detecting sensor outputs a sharp detection signal, the position detecting sensor can perform highly accurate position detection.

When the toner, the photoreceptor, the charging unit, a developing unit, a transferring unit, and the like deteriorate, the abnormal image is formed in a linear detection pattern image. The abnormal image is, for example, an image with decreased image density, the "pinhole", or a "wormhole". When the image density of the detection pattern decreases, the detection signal outputted from the position detecting sensor and serving as the position detection data of the detection pattern becomes broad. As a result, position information acquired based on the position detection data varies. When the charging unit and the photoreceptor deteriorate, the "pinhole" is formed in the linear detection pattern. When the "pinhole" is formed, an output value outputted from the position detecting sensor significantly decreases, and the position information cannot be acquired from the position detection data. When the "wormhole" is formed in the linear detection pattern as a result of the deterioration of the transferring unit, the position detection data acquired by the position detecting sensor has two peaks.

In this way, through keen examination, the inventors have found a correlation between the position detection data acquired by the position detecting sensor and device deterioration. In other words, the inventors have found that the information acquired from the position detection data includes information on the deterioration of the toner, the photoreceptor, the charging unit, the developing unit, the transferring unit, and the like. The information on the deterioration of the toner, the photoreceptor, the charging unit, the developing unit, the transferring unit, and the like is information useful for the prediction and judgment of the device failure and the device life.

Toner is deposited onto an image carrier surface until a transfer position or a photoreceptor cleaning position is reached. Materials added to the toner, such as silica, titanium oxide, and wax, may be deposited onto the image carrier surface. Over time, various contaminants form a film over a photoreceptor surface, depending on usage environment, usage conditions, and the like of the device. As a result, the image carrier deteriorates.

Reflection light reflected by the image carrier surface differs between when scratching or filming occurs on the image carrier surface and when scratching and filming do not occur on the image carrier surface. In other words, the detection data regarding the reflection light reflected by the image carrier surface includes information on the deterioration of the photoreceptor.

SUMMARY OF THE INVENTION

It is an object of the present invention to at least partially solve the problems in the conventional technology.

According to an aspect of the present invention, an image forming apparatus includes an acquiring unit that acquires a plurality of types of operation control information of the image forming apparatus; an index value calculating unit that calculates an index value indicating a state of the image forming apparatus based on the acquired operation control information; an abnormality judging unit that judges whether the image forming apparatus abnormality has occurred and predicts an occurrence of a failure based on the index value; and a detection pattern position detecting unit that detects a position of a detection pattern on an image carrier carrying a toner image. The detection pattern is formed on the image carrier carrying the toner image, and the detection pattern position detecting unit detects the position of the detection pattern formed on the image carrier. The index value calculating unit uses information based on position detection data as the operation control information of the image forming apparatus.

According to another aspect of the present invention, an image forming apparatus includes an acquiring unit that acquires a plurality of types of operation control information of the image forming apparatus, an index value calculating unit that calculates an index value indicating a state of the image forming apparatus based on the acquired operation control information; an abnormality judging unit that judges whether the image forming apparatus abnormality has occurred and predicts an occurrence of a failure based on the index value; and a surface state detecting unit that includes a light-emitting element that emits light toward a predetermined position on an image carrier surface carrying a toner image, and a light-receiving unit that receives light emitted from the light-emitting unit and reflected by the image carrier surface. The index value calculating unit uses detection data from the light-receiving unit as the operation control information of the image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A first embodiment of the present invention is below described with reference to the attached drawings.

Figure 1:
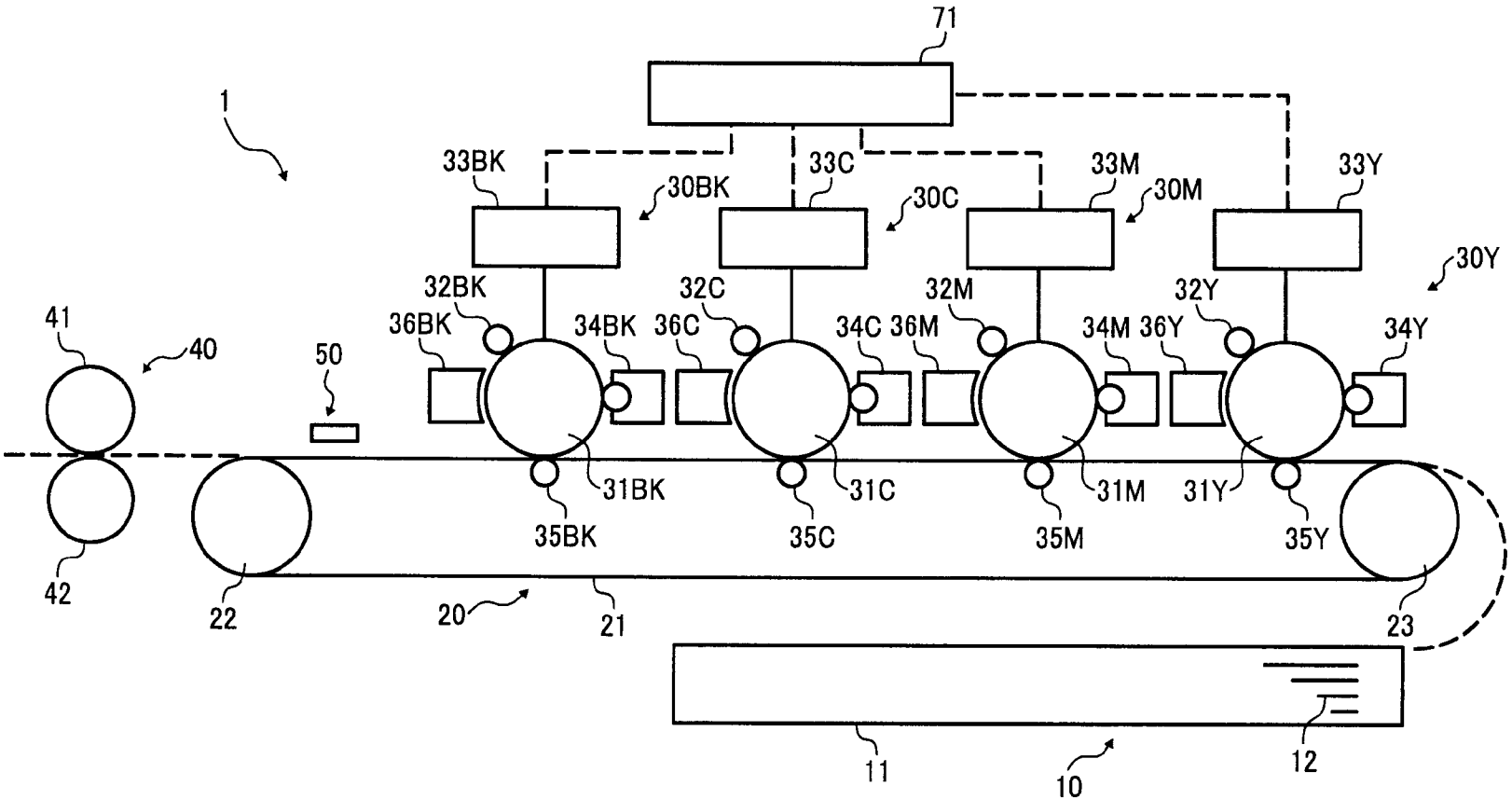
FIG. 1 is a schematic diagram of an example of an image forming apparatus according to an embodiment of the present invention.

FIG. 1 is a schematic diagram of an example of an image forming apparatus to which the invention is applied.

Figure 2:
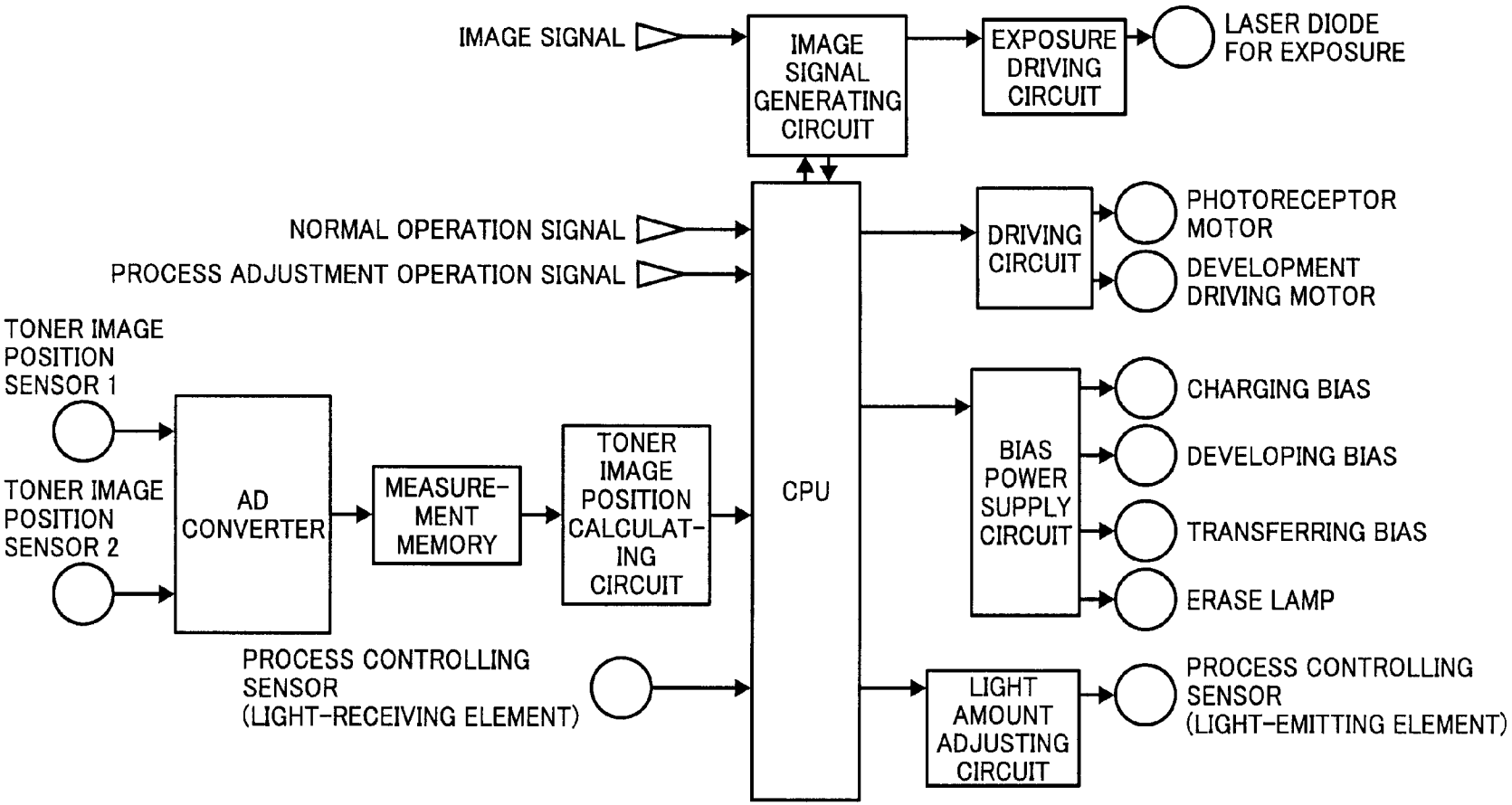
FIG. 2 is a block diagram of main components of a system controller in the image forming apparatus.

FIG. 2 is a block diagram of main components of a system controller 71 in the image forming apparatus.

In FIG. 1, a color image forming apparatus 1 includes, within a main body housing, a paper supplying unit 10, a conveyor belt mechanism unit 20, an image forming unit 30Y, an image forming unit 30M, an image forming unit 30C, and an image forming unit 30Bk. The image forming unit 30Y is for color yellow (Y). The image forming unit 30M is for color magenta (M). The image forming unit 30C is for color cyan (C). The image forming unit 30Bk is for color black (Bk). The image forming unit 30Y, the image forming unit 30M, the image forming unit 30C, and the image forming unit 30Bk are disposed along the conveyor belt mechanism unit 20. The color image forming apparatus 1 also includes a fixing unit 40, and a position detecting unit 50. The position detecting unit 50 detects a position of a detection pattern image. In addition, the color image forming apparatus 1 includes a controlling unit, a motor, a driving mechanism unit, and the like (not shown). The controlling unit controls each component of the color image forming apparatus 1. The driving mechanism unit transmits driving power to each component driven by the motor.

The paper supplying unit 10 separates recording paper (transfer paper) 12 from within a paper supplying cassette 11, one sheet at a time, using, for example, a paper supplying roller and a separating component (not shown). Then, the paper supplying unit 10 sends the recording paper 12 to a pair of resist rollers (not shown). The pair of resist rollers adjusts a timing of the recording paper 12 sent from the paper supplying cassette 11 and sends the recording paper 12 to the conveyor belt mechanism unit 20 at a predetermined timing.

The conveyor belt mechanism unit 20 includes a conveyor belt 21, a driving roller 22, a driven roller 23, and the like. The conveyor belt 21 passes around the driving roller 22 and the driven roller 23. The driving roller 22 is rotated by a driving mechanism, such as a motor (not shown), under control of the system controller 71 shown in FIG. 2. The driving roller 22 is rotated in a counterclockwise direction in FIG. 1. As a result, the conveyor belt 21 successively carries the recording paper 12 sent from the paper supplying unit 10 to the image forming unit 30Y, the image forming unit 30M, the image forming unit 30C, and the image forming unit 30Bk. The image forming unit 30Y forms a yellow toner image on the carried recording paper 12. The image forming unit 30M forms a magenta toner image on the carried recording paper 12. The image forming unit 30C forms a cyan toner image on the carried recording paper 12. The image forming unit 30Bk forms a black toner image on the carried recording paper 12. The images are successively formed.

Figure 3:
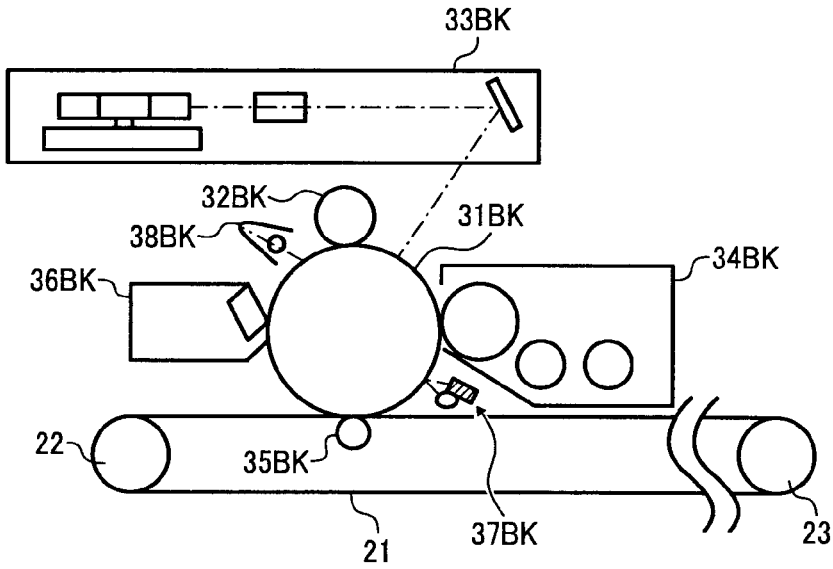
FIG. 3 is a schematic diagram of a Bk color image forming unit.

Next, an image forming unit 30 for each color will be described. Here, the image forming unit 30Bk for the color Bk will be described. However, the image forming unit 30Y for the color Y, the image forming unit 30M for the color M, and the image forming unit 30C for the color C have the same configuration. As shown in FIG. 3, for example, in the image forming unit 30Bk, a charging unit 32Bk, an exposing unit 33Bk, a developing unit 34Bk, a process controlling sensor 37Bk, a transferring unit 35Bk, a cleaning unit 36Bk, an erase lamp 38Bk, and the like are disposed around a photoreceptor (photosensitive drum) 31Bk.

When an image is formed, after an upper-level controlling device in the image forming apparatus gives an instruction by sending a normal operation signal, a driving motor (not shown) rotates the photoreceptor 31Bk, under the control of the system controller 71. A central processing unit (CPU) sequentially outputs a bias output for each imaging forming step, such as a driving unit and a charging bias. The driving unit is, for example, a photoreceptor motor. An image signal generating circuit in the system controller 71 performs image processing, such as a color converting process, on a color image signal outputted from an external device. The color image signal is outputted to the exposing unit 33Bk as an image signal in each color, Bk, Y, M, and C. The exposing unit 33Bk converts a Bk image signal to a light signal using an exposure driving circuit in the system controller 71. The exposing unit 33Bk scans and exposes the photoreceptor 31Bk while flashing a laser diode used for exposure based on the light signal, thereby forming an electrostatic latent image.

The developing unit 34Bk develops the electrostatic latent image formed on the photoreceptor 31Bk and forms a Bk toner image. The transferring unit 35Bk transfers the Bk toner image formed on the photoreceptor 31Bk onto the recording paper 12 on the conveyor belt 21. The cleaning unit 36Bk cleans residual toner from the photoreceptor 31Bk after the Bk toner image is transferred. An erase lamp 38Bk discharges the photoreceptor 31Bk, and the photoreceptor 31Bk prepares for a next image formation.

The process controlling sensor 37 Bk detects a density of a gradation pattern formed during a process adjustment operation. The process adjustment operation adjusts process conditions, such as a developing bias, the charging bias, and an exposure amount, described hereafter. An analog light amount sensor is widely used as the process controlling sensor 37Bk. The analog light amount sensor includes a light-emitting element and a light-receiving element. According to the embodiment, the process controlling sensor 37Bk is disposed facing the photoreceptor 31Bk. However, the process controlling sensor 37Bk can also be disposed facing a component that can carry the gradation pattern, such as the conveyor belt 21 and an intermediate transfer belt.

Similarly, the image forming unit 30Y, the image forming unit 30M, and the image forming unit 30C each include a charging unit, a developing unit, a cleaning unit, an erase lamp, a process controlling sensor, and the like around respective photoreceptor 31Y, photoreceptor 31M, and photoreceptor 31C. A Y toner image is formed on the photoreceptor 31Y. An M toner image is formed on the photoreceptor 31M. A C toner image is formed on the photoreceptor 31C. The toner images are overlapped and transferred onto the recording paper 12 on the conveyor belt 21.

As described above, the toner images in the color Y, the color M, the color C, and the color Bk are transferred onto the recording paper 12. The images in each color are formed on the recording paper 12. The recording paper 12 that is attached to the conveyor belt 21 by static electricity is further carried by the conveyor belt 21. The recording paper 12 is separated from the conveyor belt 21 and sent to the fixing unit 40.

The fixing unit 40 includes a fixing roller 41, a pressing roller 42, a pair of paper discharging rollers (not shown), and the like. When one roller, among the fixing roller 41 and the pressing roller 42, is rotated by application of a predetermined compressive force, another roller turns in accompaniment. An internal heater heats the fixing roller 41 to a predetermined fixing temperature and controls the temperature.

The recording paper 12 on which the toner images in the color Y, the color M, the color C, and the color Bk are transferred is sent to the fixing unit 40 by the conveyor belt 21. In the fixing unit 40, the fixing roller 41 and the pressing roller 42 heat and compress the recording paper 12. As a result, the toners in each color are fixed to the recording paper 12. The pair of paper discharging rollers discharges the recording paper 12 onto a discharged paper tray (not shown).

Figure 4:
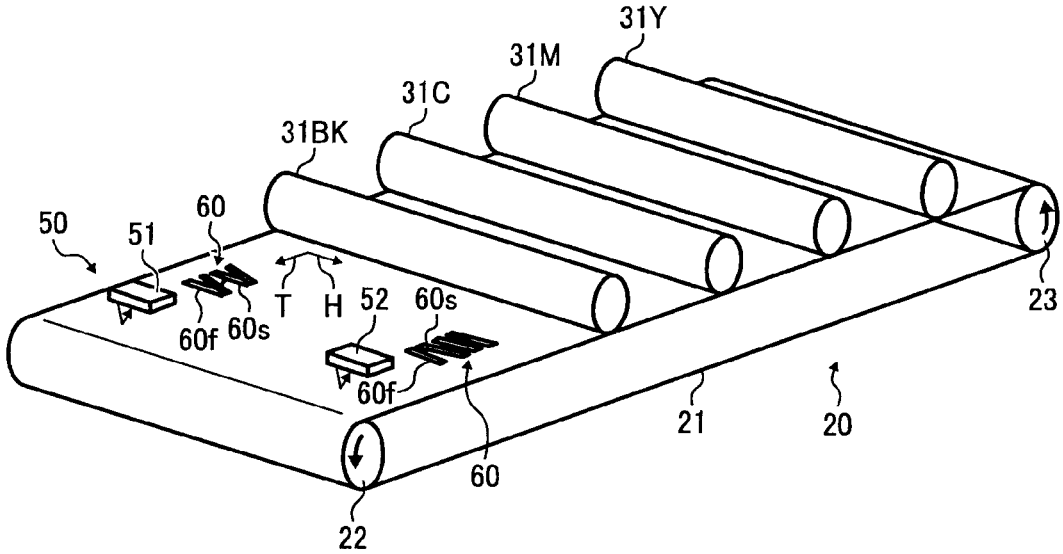
FIG. 4 is a perspective view of main components in a configuration example of a position detection pattern on a conveyor belt and a position detecting sensor.
Figure 5:
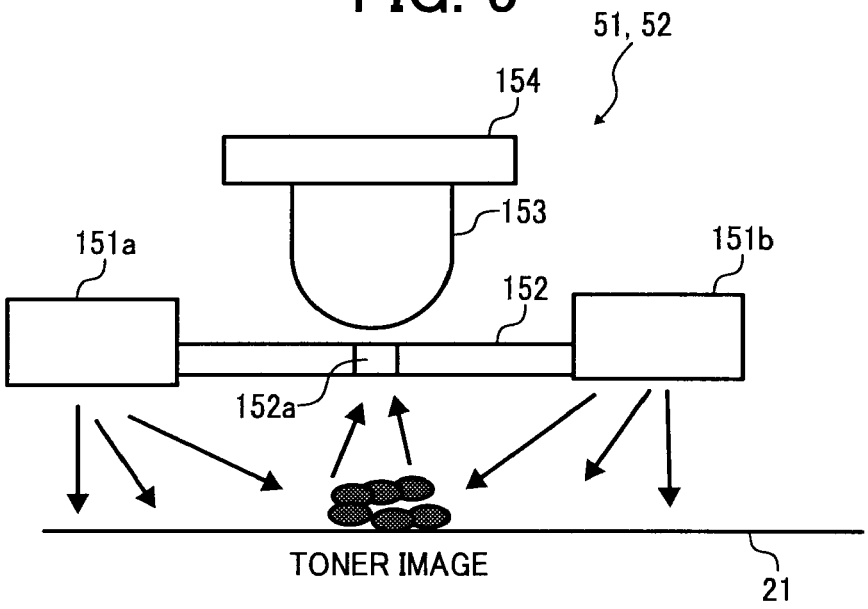
FIG. 5 is a schematic diagram of an example of the position detecting sensor.

The position detecting unit 50 is disposed in the image forming unit 30Bk for the color Bk on a downstream side in a direction in which the recording paper 12 is sent. As shown in FIG. 4, the position detecting unit 50 includes a position detecting sensor 51 and a position detecting sensor 52 that are disposed as a pair in a width direction of the conveyor belt 21. The position detecting sensor 51 and the position detecting sensor 52 include a light source 151*a* and a light source 151*b*, a slit board 152, a lens 153, and a light-receiving element 154, as shown in FIG. 5. The light source 151*a* and the light source 151*b* are two light-emitting diodes or the like. A slit 152*a* transmitting light reflected by the toner image is formed on the slit board 152. The lens 153 collects the light transmitted through the slit 152*a*. The light-receiving element 154 is a photodiode or the like that receives the light collected by the lens 153. The light source 151*a* and the light source 151*b* are provided on both ends of the slit board 152. The light-receiving element 154 does not receive direct reflection light reflected by the conveyor belt 21 serving as the image carrier. The light-receiving element 154 is disposed in a position allowing the light-receiving element 154 to receive reflection light when the toner image is present. The light-receiving element 154 is connected to the system controller 71 that processes a signal from the light-receiving element 154.

Figure 6:
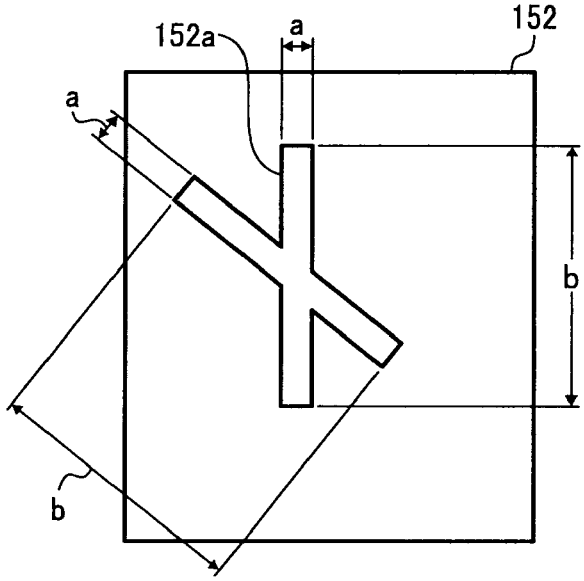
FIG. 6 is a schematic diagram of a slit.
Figure 7:
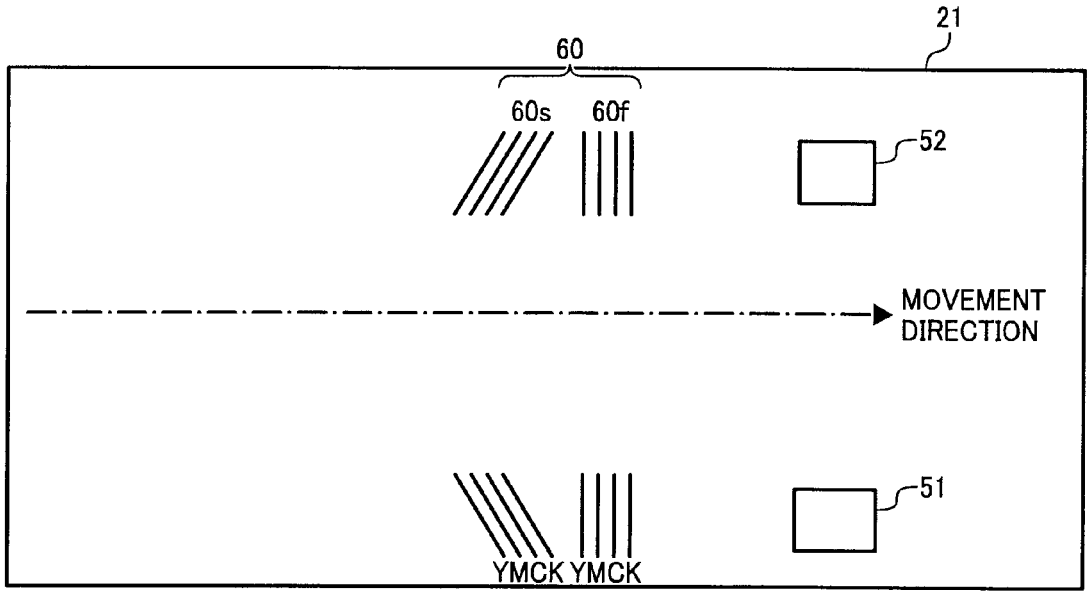
FIG. 7 is a diagram of a position detection pattern image formed on the conveyor belt.

Next, a position detection pattern image and a shape of a slit 152*a* provided on the slit board 152 will be described. FIG. 6 is a diagram of the shape of the slit 152*a*. FIG. 7 is a diagram of a position detection pattern image 60 formed on the conveyor belt 21. The position detection pattern image 60 is formed on the conveyor belt 21 in a position facing the sensor 51 and the sensor 52. The position detection pattern image 60 includes a linear detection pattern image 60*f* that runs parallel to a main scanning direction (also referred to, hereinafter, as a "horizontal line pattern") and a linear detection pattern image 60*s* that is slanted at an angle to the horizontal line pattern (also referred to, hereinafter, as a "slanted line pattern"). K within the position detection pattern image 60 indicates a pattern formed using black toner. C within the position detection pattern image 60 indicates a pattern formed using cyan toner. M within the position detection pattern image 60 indicates a pattern formed using magenta toner. Y within the position detection pattern image 60 indicates a pattern formed using yellow toner.

As shown in FIG. 6, the slit 152*a* is formed in an X-shape having a portion formed in a same direction as the horizontal line pattern 60*f* in the position detection pattern image 60 and a portion formed in a same direction as the slanted line pattern 60*s*. A width of the slit 152*a* is "a". A length of the slit 152*a* is "b". A width of the position detection pattern image 60 is same as the width "a" of the slit 152*a*. A length of the position detection pattern image 60 is longer than the length "b" of the slit 152*a*. As a result, the diffused reflection light only enters the light-receiving element 154 when the position detection pattern image 60 reaches a position facing the light-receiving element 154. Therefore, a detection waveform outputted from the light-receiving element 154 when the position detection pattern image 60 is detected becomes sharp. The position can be successfully detected.

Figure 8A:
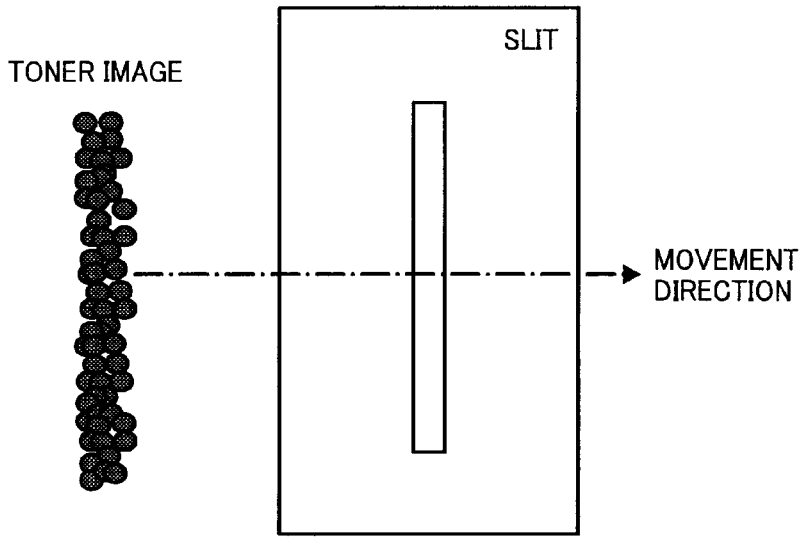
FIG. 8A is an explanatory diagram of the position detecting sensor detecting the position detection pattern image.
Figure 8B:
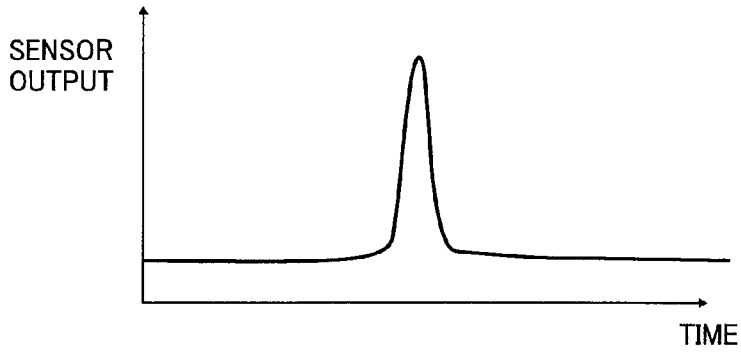
FIG. 8B is an explanatory diagram of a sensor output when the position detecting sensor detects the position detection pattern image.

Next, position detection of the position detection pattern image 60 performed by the position detecting sensor 51 and the position detecting sensor 52 will be described with reference to FIG. 8A, FIG. 8B, and FIG. 8C. In accompaniment with a movement of the conveyor belt 21 in a sub-scanning direction, as shown in FIG. 8A, each position detection pattern image 60 successively passes through a position facing the slit 152*a*. A surface of the conveyor belt 21 is smooth. Therefore, when the position detection pattern image 60 has not reached the position facing the light-receiving element 154, most of the light from the light source 151*a* and the light source 152*b* are directly reflected. Only a small amount of reflection light enters the light-receiving element 154. As a result, as shown in FIG. 8B, sensor output from the light-receiving element 154 is minimal. When the position detection pattern image 60 reaches the position facing the light-receiving element 154, the light from the light source 151*a* and the light source 151*b* is diffused and reflected. Therefore, the amount of light entering the light-receiving element 154 increases and, as shown in FIG. 8B, the sensor output increases.

Figure 8C:
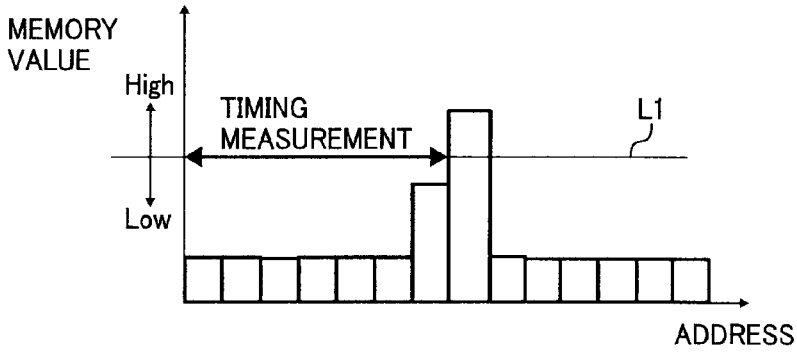
FIG. 8C is an explanatory diagram of measurement of a position detection pattern position based on sensor output values.

As shown in FIG. 2, sensor outputs from the position detecting sensor 51 and the position detecting sensor 52 are stored in a measurement memory, after being converted to digital time sequence values by an analog-to-digital (AD) converter in the system controller 71 (see FIG. 8C). Then, a toner image position calculating circuit finds a point on a low-to-high (L-to-H) edge line L1 of a memory value in the measurement memory at which the memory value transitions from low to high. As a result, position analysis can be accurately performed using a high-speed signal. From an arrival time difference between a left-hand side and a right-hand side of the position detection pattern image 60, an arrival time difference between horizontal line patterns 60*f*, and an arrival time difference between the slanted line pattern 60*s* and the horizontal line pattern 60*f*, relative horizontal position, vertical position, angle, and scale of each color are calculated. The calculation result is sent to an image signal generating circuit. Correction (resist correction) is performed so that the image is formed in an appropriate position. Color shifting correction is completed.

Next, color shift correction control in which the above-described color shift correction is performed will be described.

Expansion and contraction of a device structure caused by temperature changes contributes greatly to color shifting. Therefore, the color shifting correction control is performed, for example, about every 100 times an image is formed, when temperature changes by more than a predetermined value, and when a number of consecutive prints exceeds a predetermined value.

Figure 9:
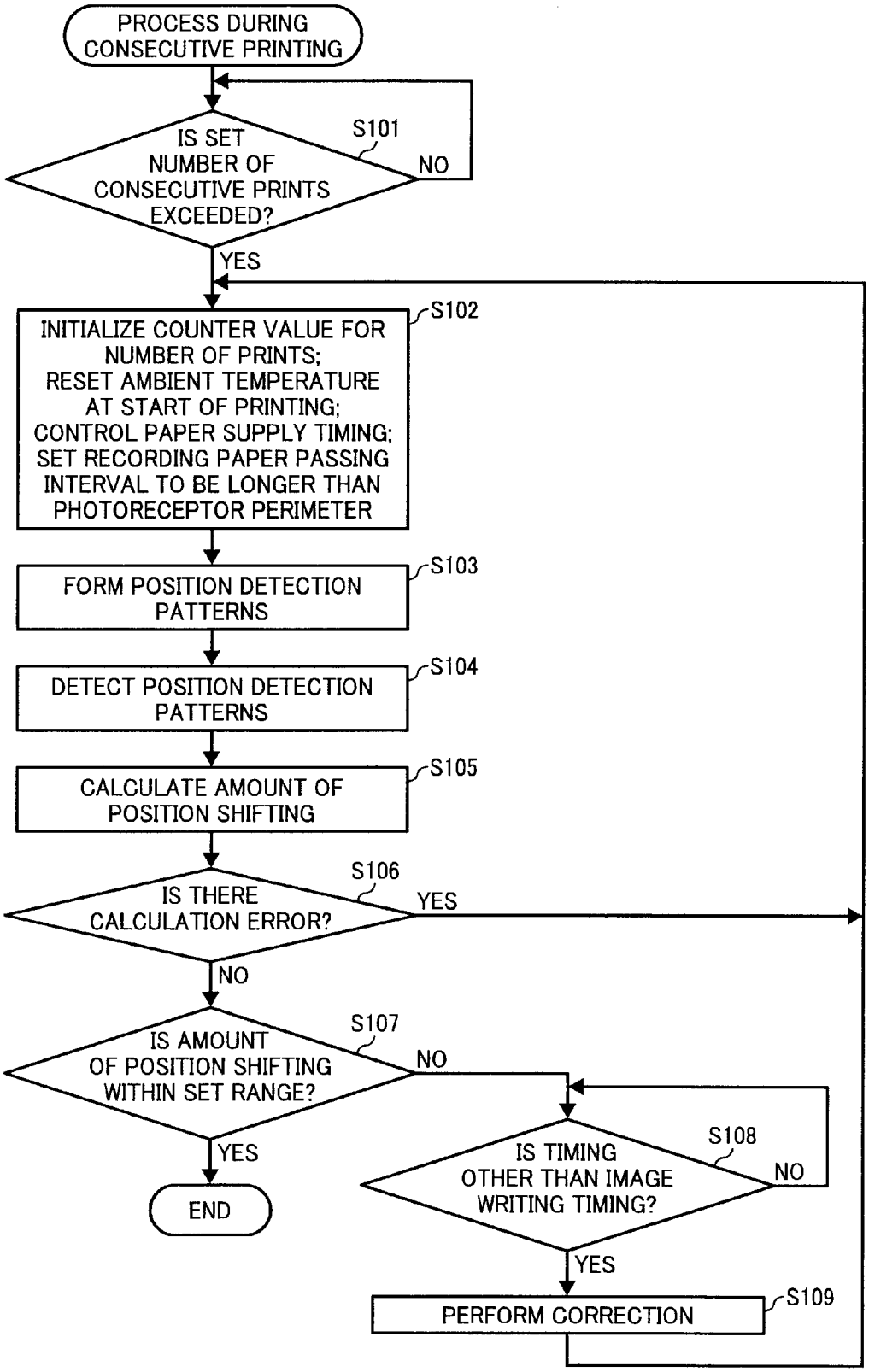
FIG. 9 is a flowchart of an example of color shifting correction control.

FIG. 9 is a flowchart of an example of the color shifting correction control.

The color shifting correction control shown in FIG. 9 is performed when the number of consecutive prints exceeds the predetermined value.

The system controller 71 counts a number of prints every time a sheet of recording paper 12 is sent from the paper supplying unit 10. When consecutive printing starts, the system controller 71 reads a counter value and stores the counter value in a memory.

First, in the image forming apparatus 1, the system controller 71 counts the number of prints and calculates the number of consecutive prints from a difference between a current counter value and the counter number stored in the memory at the start of the printing. Next, the system controller 71 checks whether the calculated number of consecutive prints exceeds a set number of consecutive prints stored in the memory in advance (S101). When the number of consecutive prints does not exceed the set number of consecutive prints (NO at S101), an ordinary printing process is performed.

At the same time, when the number of consecutive prints exceeds the set number of consecutive prints (YES at S101), the system controller 71 performs the color shifting correction control. At the same time, the system controller 71 updates the counter value stored in the memory at the start of the printing to the counter value of the number of prints counted by the system controller 71 (the current counter value). After writing is completed in the image forming unit 30Y, the system controller 71 delays a paper supplying timing and changes a paper passing interval at which the recording paper 12 is passed from a paper passing interval for consecutive printing to a paper passing interval for color shifting correction. The paper passing interval for color shifting correction is longer than respective perimeters L of the photoreceptor 31Y, the photoreceptor 31M, the photoreceptor 31C, and the photoreceptor 31Bk (S102).

Next, the system controller 71 controls the image forming unit 30Y, the image forming unit 30M, the image forming unit 30C, and the image forming unit 30Bk. The system controller 71 forms the position detection pattern image 60*f* and the position detection pattern image 60*s*, shown in FIG. 7, on both ends of the conveyor belt 21 in the width direction (main scanning direction) (S103). The formed position detection pattern image 60*f* and the position detection pattern image 60*s* are sent to the position detecting unit 50. The position detecting sensor 51 and the position detecting sensor 52 detect the position detection pattern image 60*f* and the position detection pattern image 60*s* (S104). When the formation of the position detection pattern image 60*f* and the position detection pattern image 60*s* is completed, the paper passing interval is returned to the normal paper passing interval for consecutive printing. A consecutive printing process is continued.

The detection signals from the position detecting sensor 51 and the position detecting sensor 52 are converted to digital signals by the AD converter and stored in the measurement memory. Next, the system controller 71 reads detection results from the position detecting sensor 51 and the position detecting sensor 52 stored in the measurement memory. The system controller 71 calculates an amount of position (color) shifting (skew-shifting amount, main scanning resist shifting amount, main scanning scale shifting amount, and sub-scanning resist shifting amount) (S105). When the position detection pattern image 60 cannot be detected and the amount of position (color) shifting cannot be calculated (YES at S106) as a result of the device deterioration or the like, described hereafter, steps subsequent to S102 are repeated.

At the same time, when the amount of position (color) shifting is calculated (NO at S106), the amount of position (color) shifting is compared with a reference setting amount of position (color) shifting stored in the memory in advance. Whether the calculated amount of position (color) shifting is within a range of the reference setting amount of position (color) shifting is checked (S107). When the calculated amount of position (color) shifting is out of the range of the reference setting amount of position (color) shifting (NO at S107), a correction amount is calculated from the amount of position (color) shifting (the skew-shifting amount, the main scanning resist shifting amount, the main scanning scale shifting amount, and the sub-scanning resist shifting amount). Next, setting values of control signals for a writing clock, a writing timing, and the like are outputted to the system controller 71. The setting values are provided by an exposing unit 33Y in the image forming unit 30Y, an exposing unit 33M in the image forming unit 30M, an exposing unit 33C in the image forming unit 30C, and the exposing unit 33Bk in the image forming unit 30Bk. Based on the setting values of the control signals for the writing clock, the writing timing and the like, and the correction amount, the system controller 71 performs color shifting correction by changing the setting values of the writing clock, the writing timing, and the like (S109) at a timing that is not a writing timing of the image forming unit 30Y, the image forming unit 30M, the image forming unit 30C, and the image forming unit 30Bk (YES at 108). The image forming unit 30Y, the image forming unit 30M, the image forming unit 30C, and the image forming unit 30Bk are stations. After the color shifting correction is performed, the steps subsequent to S102 are repeated. Whether the color shifting correction has been correctly performed is verified.

At the same time, when the amount of position (color) shifting is within the range of the reference setting amount of position (color) shifting, the color shifting correction is unnecessary. Therefore, the system controller 71 performs a printing process to continue the consecutive printing and completes the process.

In the image forming apparatus according to the embodiment, when power is turned on or when a predetermined number of prints is printed, the process adjustment operation is also performed to optimize the image density of each color. The process adjustment operation adjusts the developing bias, the charging bias, the exposure amount, and the like.

An electrophotographic image forming apparatus has a weakness in that the image density fluctuates as a result of degradation over time and environmental changes. Therefore, the image density is stabilized by the process adjustment operation being performed.

Figure 10:
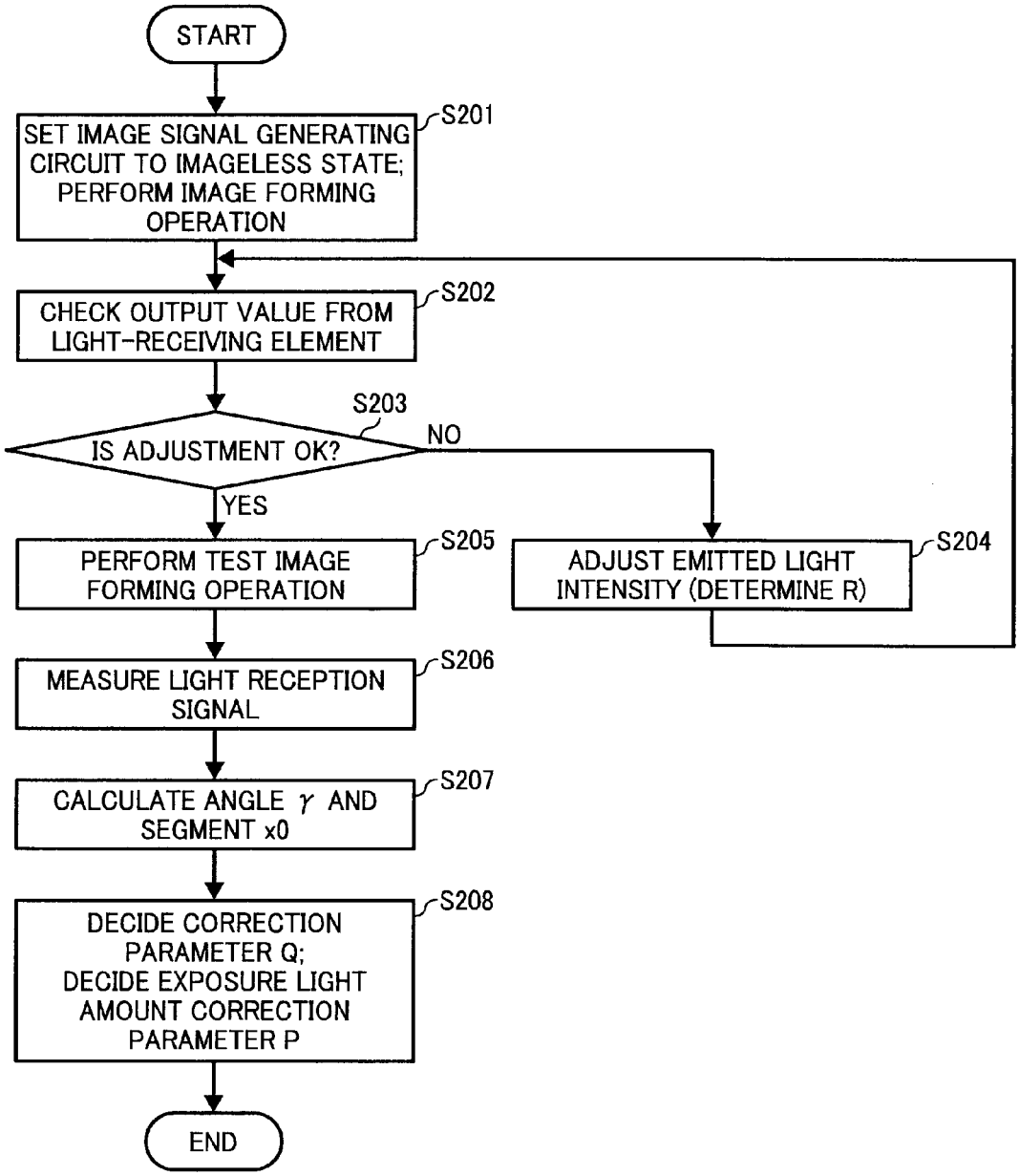
FIG. 10 is a flowchart of a process adjustment operation.

FIG. 10 is a flowchart of the process adjustment operation.

Through use of a time when the power is turned ON or before and after the predetermined number of prints is printed, the upper-level controlling device gives an instruction to the system controller 71 by sending a process adjustment operation signal, and the process adjustment operation is started.

When the process adjustment operation is started, the system controller 71 sets the image signal generating circuit to an imageless state (S201). Next, the CPU adjusts an emitted light amount R emitted from the light-emitting element of the process controlling sensor using a light amount adjusting circuit, so that the sensor output (light reception signal) is a predetermined value when the light-receiving element of the process controlling sensor detects a photoreceptor surface (S202 to S204). This operation is equivalent to a calibration operation performed by the process controlling sensor 37 to accurately measure a toner image density without being affected by variations and changes occurring over time in the light-emitting element and in the light-receiving element, and changes occurring over time in a photoreceptor surface state.

When such calibration operation performed the process controlling sensor 37 is completed, a certain test image is automatically formed on the photoreceptor (S205). The process controlling sensor 37 optically measures the test image on the photoreceptor (S206). A pattern with a uniform density that has been exposed in about five stages at different density levels is often used as the test image. At this time, the charging bias conditions and the developing bias conditions are certain values decided in advance.

Figure 11:
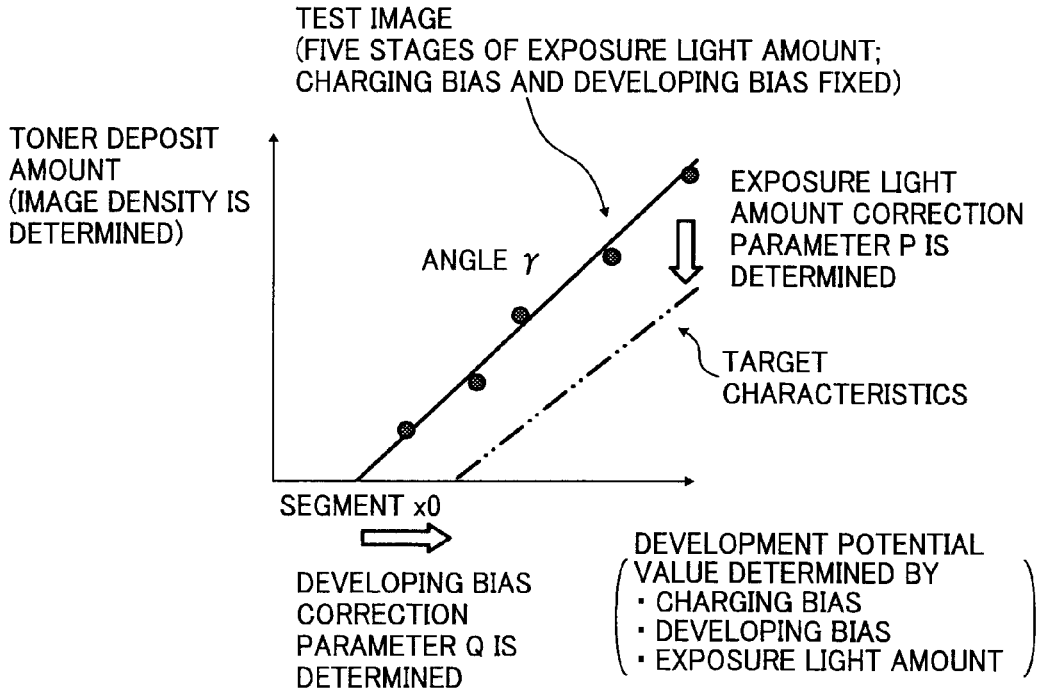
FIG. 11 is an explanatory diagram of a process adjustment method.

Next, five light reception signals from the process controlling sensor 37, obtained by detecting each test image, are converted into a toner deposit amount (image density) using a predetermined deposit amount calculation algorithm. The toner deposit amount is detected for each test image. Then, from a relationship between the toner deposit amount of each test image and respective development potentials at the time each test image was created, a development potential and toner deposit amount line with a similar line shape is determined, as shown in FIG. 11. An angle γ and a segment x0 are calculated from the development potential and toner deposit amount line (S207). As a result of the angle γ and the segment x0 being determined in this way, shifting of the angle γ and the segment x0 of the development potential and toner deposit amount line from target characteristics (dotted line in FIG. 11) caused by density fluctuation factors (degradation over time and environmental changes), described above, can be detected. An exposure light amount correction parameter P for correcting the shifting of the angle γ is decided from the angle γ. A correction parameter Q for correcting the shifting of the development potential (segment x0) at which the development starts is decided from the segment x0 (S208).

The angle γ is mainly corrected by the exposure light amount correction parameter P being multiplied with an exposure signal. The segment x0 is mainly corrected by the developing bias being multiplied with the correction parameter Q. Therefore, a stable target image density can be acquired.

The image forming apparatus according to the embodiment judges a device failure state using the emitted light amount R, the exposure light amount correction parameter P, and the correction parameter Q of the light-emitting element in the process controlling sensor 37, determined by the above-described process adjustment operation.

Each value P, Q, and R changes with deterioration of toner characteristics, photoreceptor characteristics, the charging unit, and the developing unit. When failure is judged only by a single change occurring among the values P, Q, and R, a transient signal change caused by temperature and humidity change may be mistakenly judged as the failure. When a failure judgment such as this is performed in an actual device, false alarms occur with great frequency. As a result, the image forming apparatus cannot be operated and becomes useless.

Therefore, according to the embodiment, a failure judgment that takes the three values P, Q, and R, into general consideration is performed through use of a failure judgment algorithm, such as that described hereafter. P. Q. and R are invaluable for failure judgment.

The failure judgment according to the embodiment will described below, with reference to FIG. 12 and FIG. 13.

Figure 12:
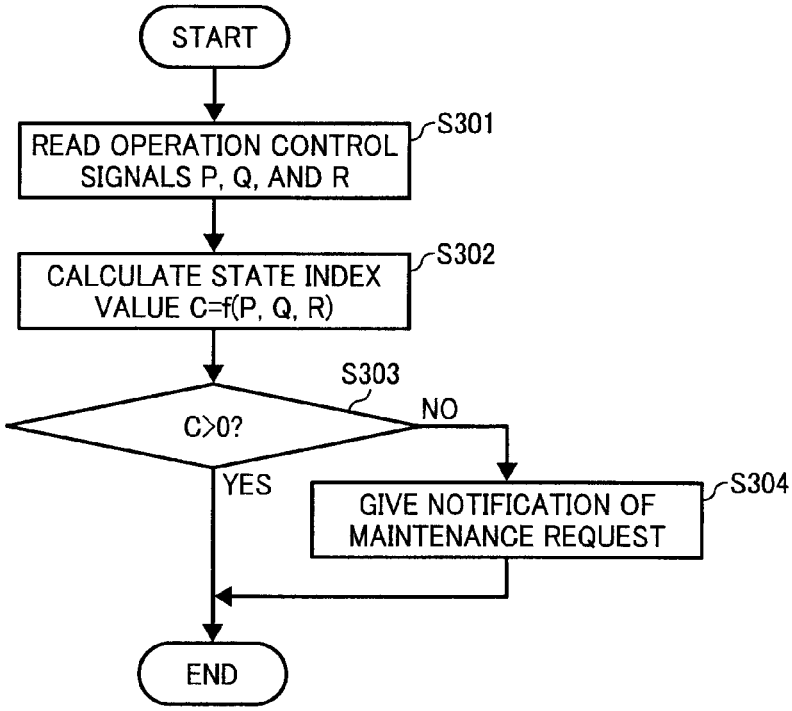
FIG. 12 is a flowchart of a failure judgment.
Figure 13:
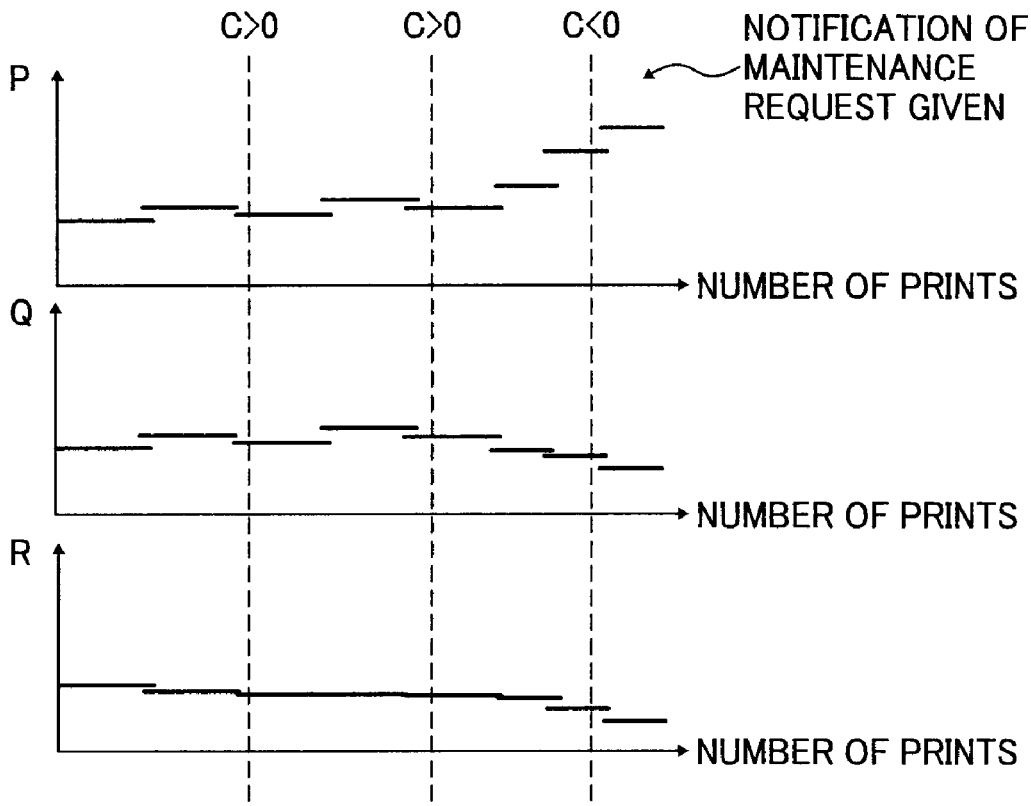
FIG. 13 is a diagram of a relationship between values P, Q, and R of operation control information and an index value C.

The failure judgment algorithm in FIG. 12 and FIG. 13 uses a first-order linear combination equation.

As shown in FIG. 12, the emitted light amount R, the exposure light amount correction parameter P, and the correction parameter Q of the light-emitting element in the process controlling sensor 37 are read as device operation control information (signals) (S301). Next, P, Q, and R are assigned to the first-order linear combination equation ($C=aP+bQ+cR$). A state index value C is determined (S302). a, b, c are weighted parameters and are by, for example, a pattern recognition algorithm. For example, the value R tends to decrease when the photoreceptor deteriorates and an amount of diffused reflection light from the photoreceptor surface increases. The value Q is similarly affected and tends to decrease. The same deterioration causes a charge potential to become insufficient and the value P tends to increase. The weighted parameters of the first-order linear combination equation are determined so that C is less than 0 ($C<0$) when the above-described condition is met and C is more than 0 ($C>0$) when the condition is not met (see FIG. 13).

As a result of the above-described failure judgment, when the device is judged to have failed ($C<0$) (NO at S303), the system controller 71 gives notification of a maintenance request through a display panel on the device or a display screen of an external device, such as a personal computer (S304). Alternatively, the system controller 71 can communicate with a service center and notify the service center of the need for maintenance.

In this way, device failure is judged (here, photoreceptor life is judged) using a plurality of pieces of operation control information (P, Q, and R). As a result, a robust failure judgment can be performed, compared to when the device failure is judged using one piece of operation control information. If the weight of the operation control information (R) acquired by the photoreceptor surface being directly measured is heavier than the operation control information (Q and P) acquired from an image output result, it can be judged that $C<0$ (the failure has occurred), at a stage when the abnormal image is not formed but the deterioration of the surface has started. As a result, the failure can be predicted.

Decisions regarding a calculation formula for calculating the state index value C and the values of the weighted parameters are preferably made by the use of the pattern recognition algorithm. Examples of applicable pattern recognition algorithms are, for example, a linear discriminant analysis (LDA) algorithm, a boosting algorithm, and a support vector machine algorithm. Through use of such pattern recognition algorithms, a function with practical benefits can be decided if the pieces of operation control information (P, Q, and R) and judgment information regarding a current photoreceptor surface state (information stating whether the photoreceptor surface state is OK or not OK) obtained from a specialist are available. In other words, through use of the pattern recognition algorithm, the function with practical benefits can be decided without a cause-and-effect relationship between the operation control information P, Q, and R and the failure being studied through experiments and mechanism analysis.

Next, a first characteristic according to the embodiment will be described.

The inventors have found that information extremely advantageous for failure judgment and failure prediction can also be acquired from sensor output values outputted from the position detecting sensor 51 and the position detecting sensor 52.

When the toner, the photoreceptor 31, the charging unit 32, the developing unit 34, the transferring unit 35, and the like deteriorate, various abnormalities occur in the position detection pattern image 60 used for color shifting correction control. This is because the position detection pattern image 60 is a line image having a line width of 0.1 millimeter to 1 millimeter. In other words, a strong edge electric field is formed along an outer circumference of the toner image. Therefore, compared to a center area of the toner image, an edge area of the toner image is easily changed by various changes in image formation conditions. As described above, the line width of the line image is narrow, equal to or less than 1 millimeter. Therefore, the line image is significantly affected by the changes in the edge area. Compared to a solid image, the abnormalities occur more easily in the line image as a result of the deterioration of the toner, the photoreceptor 31, the charging unit 32, the developing unit 34, the transferring unit 35, and the like. In other words, even when the abnormality in the image is slight and is not visible, the abnormal image is noticeable in the line image. Therefore, by the abnormality in the line image being identified, effects of the deterioration of the photoreceptor 31, the charging unit 32, the developing unit 34, the transferring unit 35, and the like can be identified while the abnormality in the image is slight and is not visible.

Figure 14A:
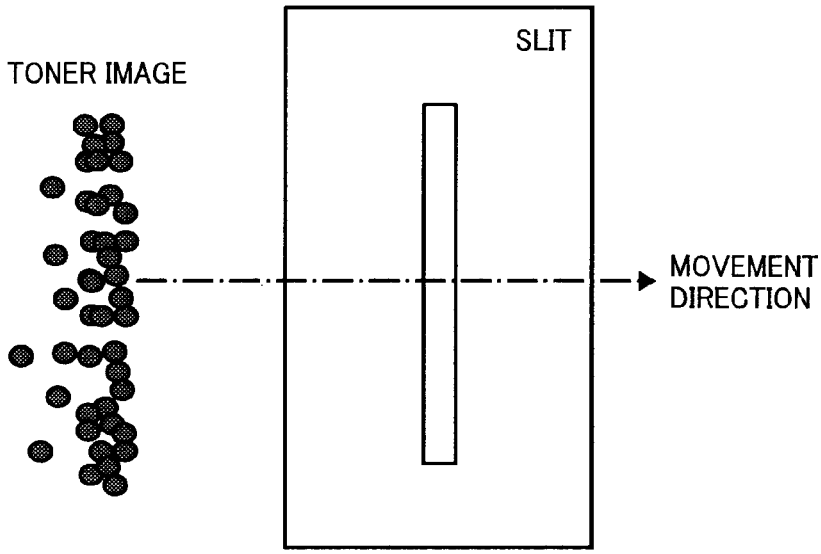
FIG. 14 is an explanatory diagram of a position detection result when the position detecting sensor detects a line image with a "missing pixel"
Figure 14B:
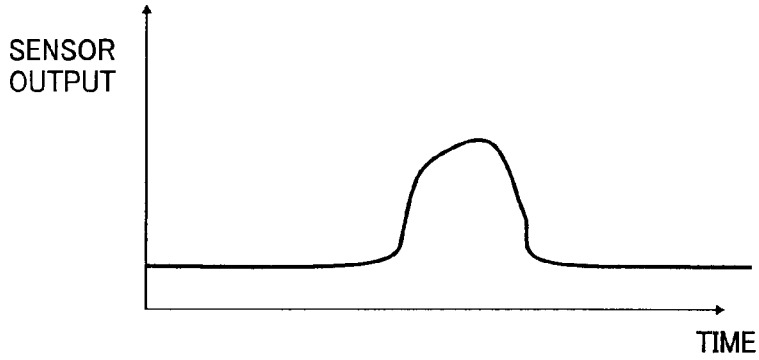
Figure 14C:
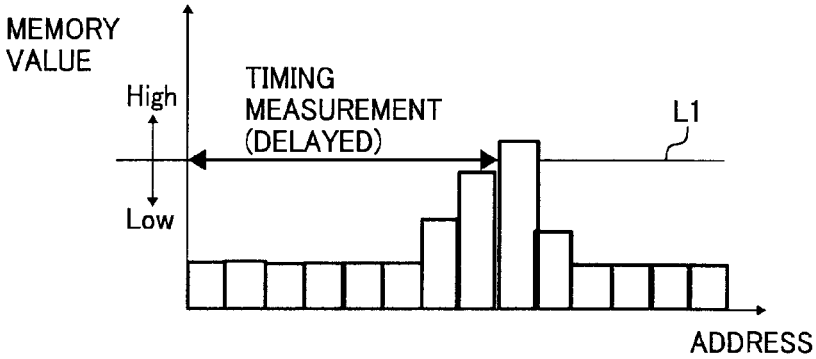

Next, abnormalities occurring in the position detection pattern image 60 that is the line image will be described. The abnormalities are caused by the deterioration of the toner, the photoreceptor 31, the charging unit 32, the developing unit 34, the transferring unit 35, and the like When the toner and the developing unit 34 deteriorate, image density decreases and a "missing pixel", such as that shown in FIG. 14A, is formed in the position detection pattern image 60. The sensor output value (detection value) outputted when the position detecting sensor 51 and the position detecting sensor 52 detect the position detection pattern with the "missing pixel" is low, as shown in FIG. 14B. Detection waveforms outputted from the position detecting sensor 51 and the position detecting sensor 52 are also broad. As a result, as shown in FIG. 14C, a position measurement result (the point where the memory value transitions from low to high) of the position detection pattern 60 acquired from memory values through position analysis becomes slightly delayed. Variations in the position measurement result become significant.

Figure 15A:
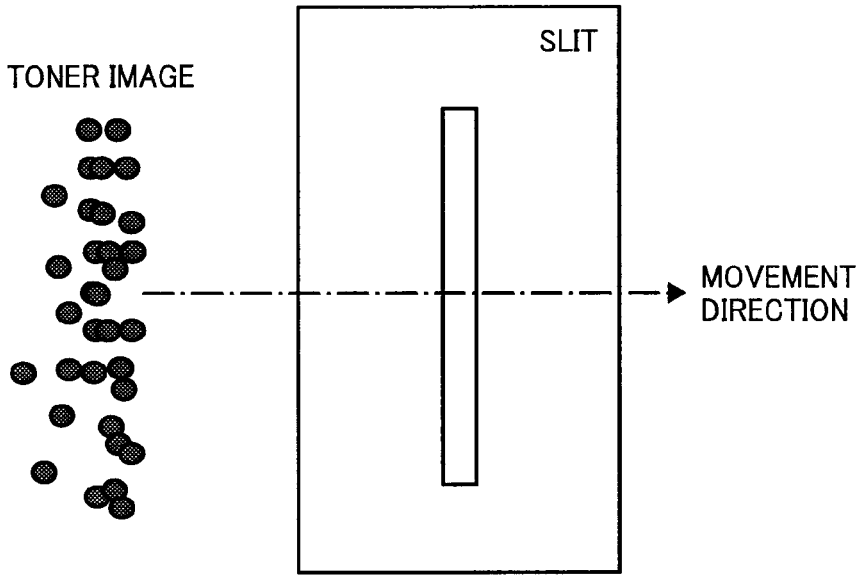
FIG. 15 is an explanatory diagram of a position detection result when the position detecting sensor detects a line image with a "pinhole"
Figure 15B:
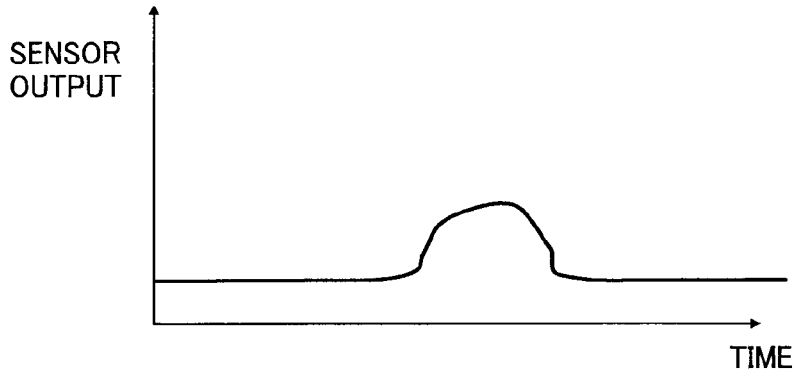
Figure 15C:
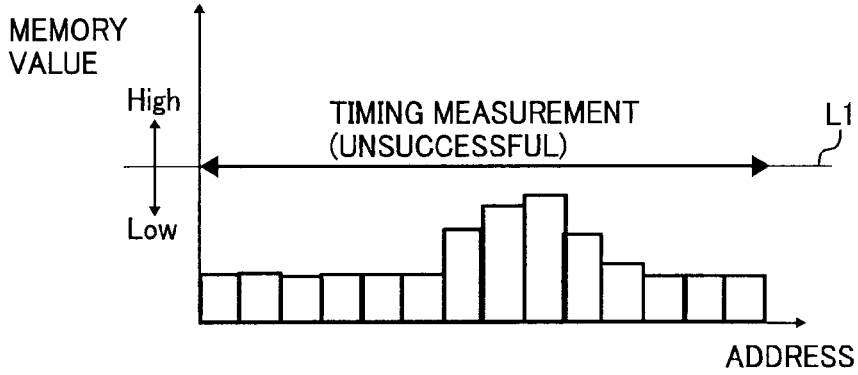

When the photoreceptor 31 and the charging unit 32 become soiled or deteriorated, the "pinhole" occurs in the position detection pattern 60 that is the line image, as shown in FIG. 15A. The sensor output value outputted when the position detecting sensor 51 and the position detecting sensor 52 detect the position detection pattern image 60 with the "pinhole", such as this, significantly decreases, as shown in FIG. 15B. As a result, the memory value of when the position detection pattern image 60 is detected does not exceed the L-to-H edge line L1 (all memory values are held low), as shown in FIG. 15C. A problem occurs in that the position of the position detection pattern image 60 cannot be detected.

Figure 16A:
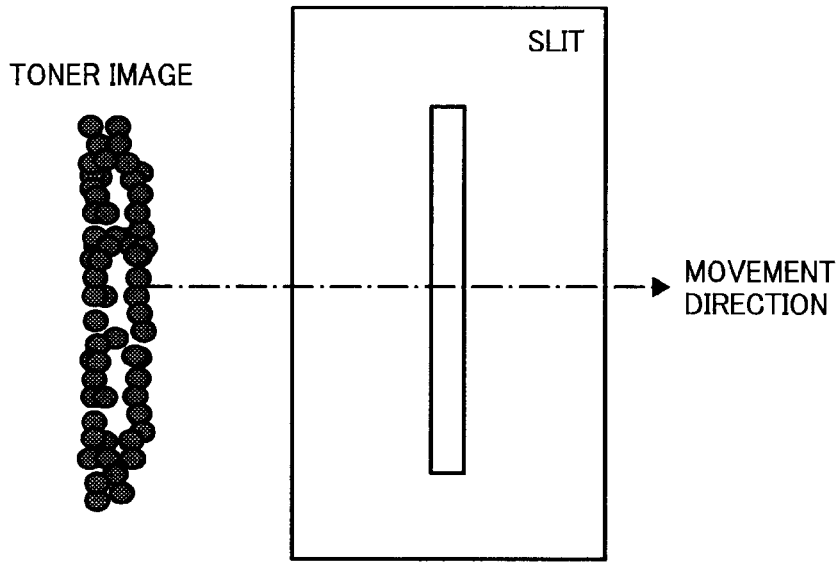
FIG. 16 is an explanatory diagram of a position detection result when the position detecting sensor detects a line image with a "wormhole"
Figure 16B:
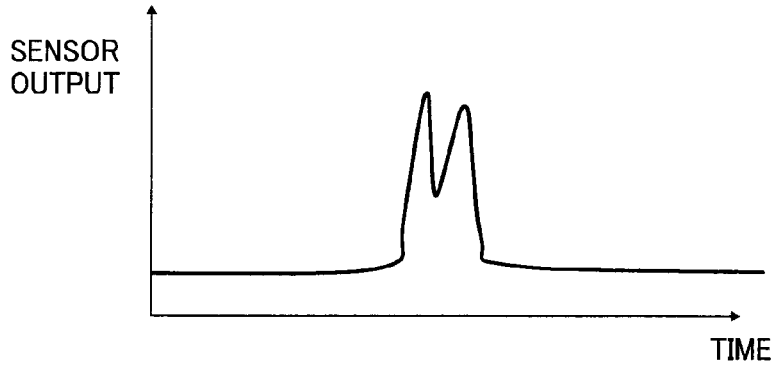
Figure 16C:
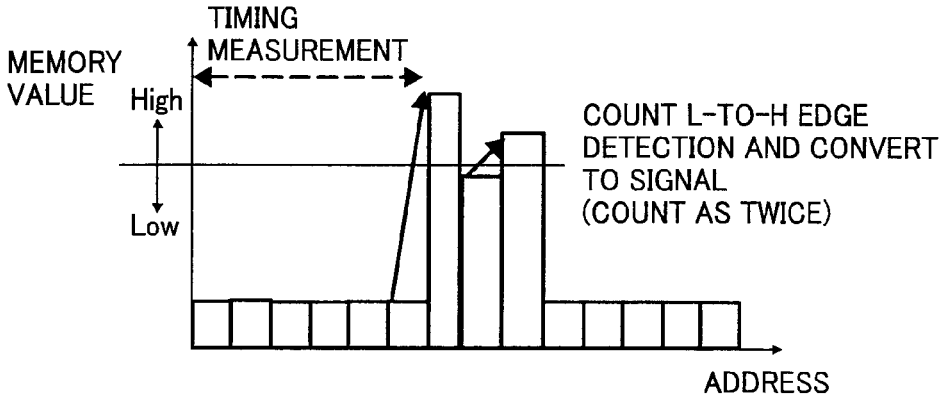

When the toner and the transferring unit 35 deteriorate, a "wormhole" is formed in the position detection pattern image 60 that is the line image, as shown in FIG. 16A. When the "wormhole" is formed in the position detection pattern image 60, the sensor output value indicates an output waveform having two peaks, as shown in FIG. 16B. As a result, the memory value that has been converted to the digital signal and stored in the memory transitions from low to high at two points, as shown in FIG. 16C. A detection result such as this is acquired because the position detecting sensor 51 and the position detecting sensor 52 perform the detection. In other words, to accurately detect the position of the position detection pattern image 60, the position detecting sensor 51 and the position detecting sensor 52 detect only the toner image facing the light-receiving element 154. Therefore, the output waveform having two peaks, such as that described above, is acquired. At the same time, a sensor that performs density detection, such as the process controlling sensor 37, cannot judge whether the position detection pattern image 60 has a hole or has decreased density, from the output value of the sensor.

Figure 17A:
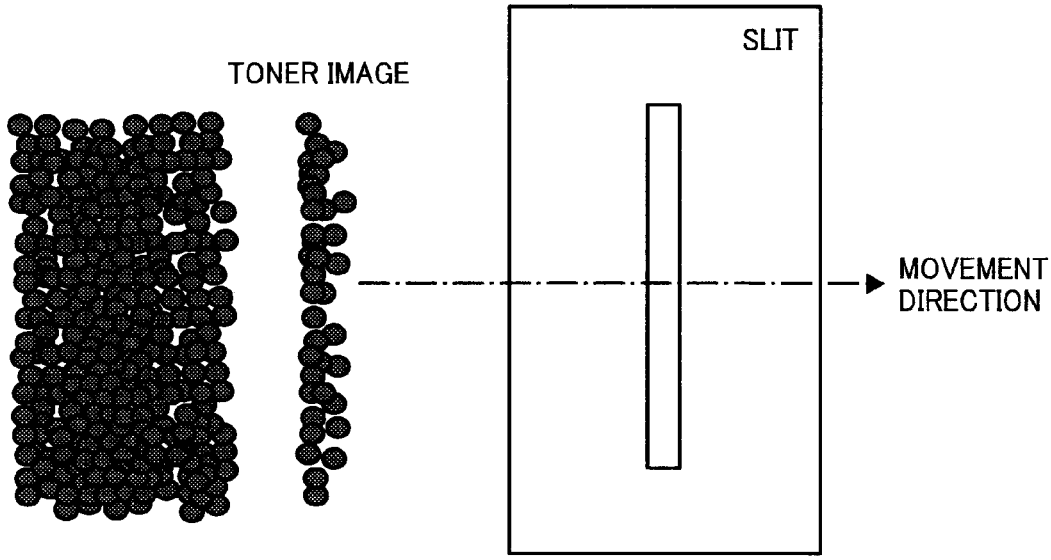
FIG. 17 is an explanatory diagram of a position detection result when the position detecting sensor detects a solid image in which a "hat" image has occurred.
Figure 17B:
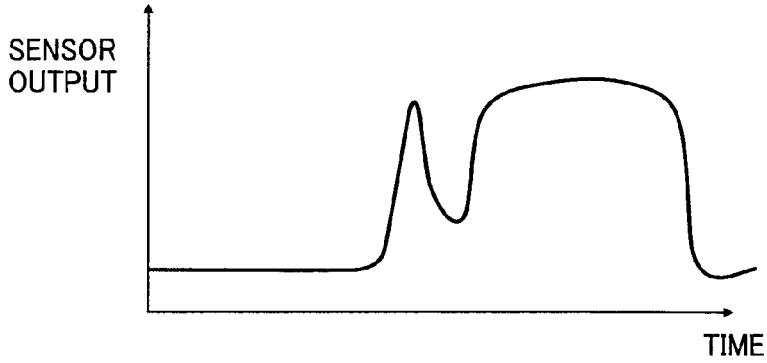
Figure 17C:
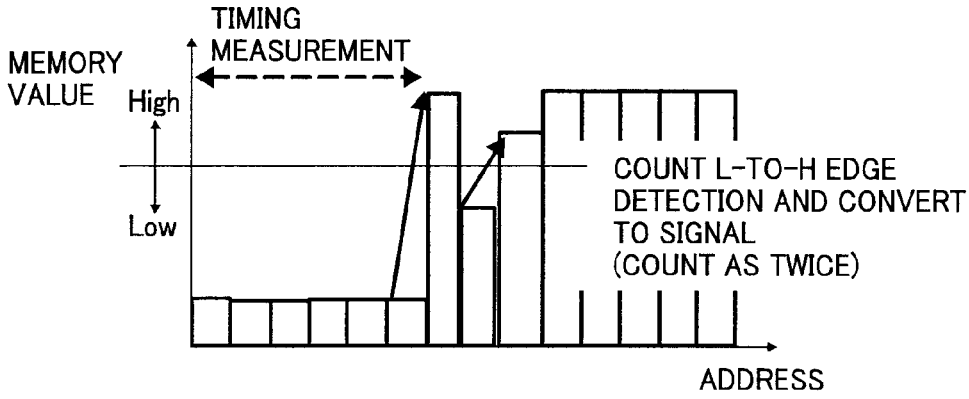

In a binary developing agent method, a so-called "hat" image may be formed when a solid image is formed as a result of deterioration of a developing agent, as shown in FIG. 17A. In the "hat" image, poorly charged toner is deposited onto a non-image area near the solid image. In the "hat" image, as well, the sensor output value indicates the output waveform with two peaks, as shown in FIG. 17B, when the position detecting sensor 51 and the position detecting sensor 52 perform the detection. Therefore, the memory value that has been converted to the digital signal and stored in the memory transitions from low to high at two points, as shown in FIG. 17C.

As in the descriptions above, when the position detection pattern image 60 that is the line image is formed and detected by the position detecting sensor 51 and the position detecting sensor 52, the abnormalities, such as the "missing pixel", the "pinhole", and the "wormhole", occurring as a result of the device deterioration can be identified. When the position detecting sensor 51 and the position detecting sensor 52 detect the solid image, the "hat" image can also be identified.

According to the embodiment, information acquired from the sensor output values (position detection data) outputted by the position detecting sensor 51 and the position detecting sensor 52 are used in the above-described failure judgment. Details will be described below, based on a first example and a second example.

In the first example, a failure detection pattern is formed. The position detecting sensor 51 and the position detecting sensor 52 detect the failure detection pattern and acquire the operation control information used for the failure judgment.

Figure 18:
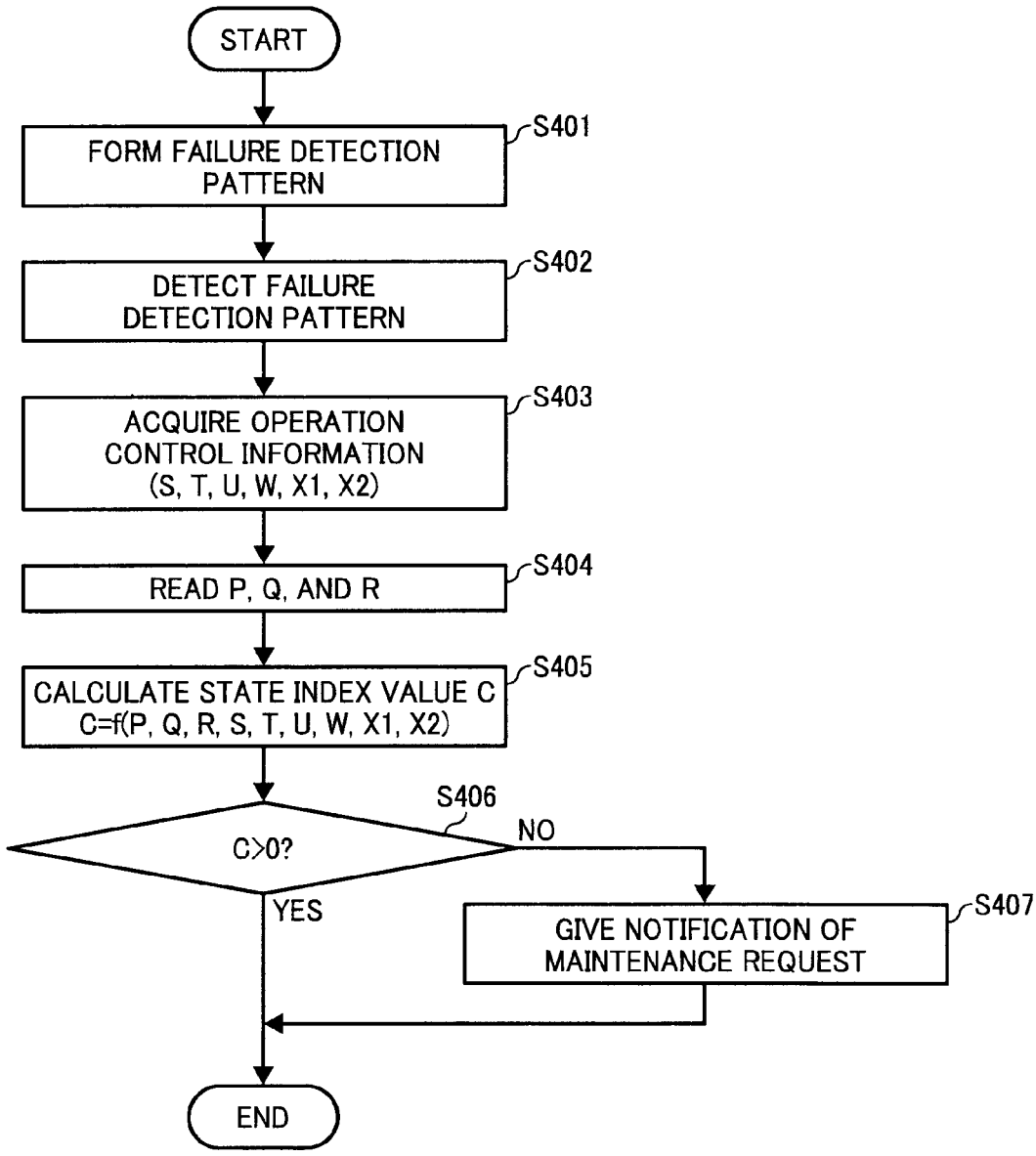
FIG. 18 is a flowchart of an acquisition of the operation control information according to a first example.

FIG. 18 is a flowchart of an acquisition of the operation control information based on position information from the position detecting sensor 51 and the position detecting sensor 52.

First, after a predetermined number of images are formed or after an environment has changed by a predetermined amount, the system controller 71 starts an operation control information acquisition control.

Figure 19A:
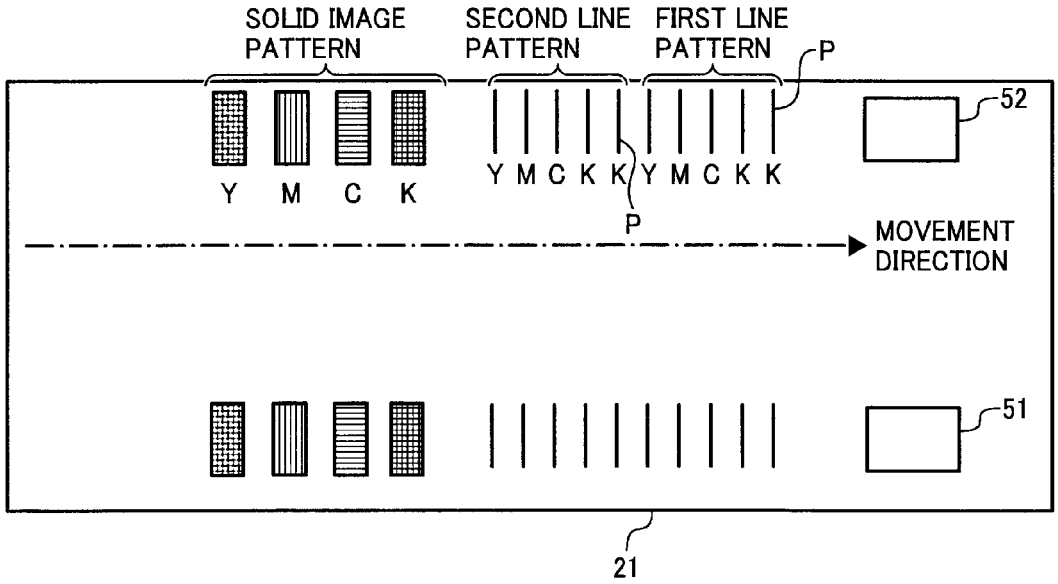
FIG. 19A is a diagram of a failure detection pattern formed on the conveyor belt.

When the operation control information acquisition control is started, a failure detection pattern, such as that in FIG. 19A, is formed (S401). The failure detection pattern includes a first line pattern, a second line pattern, and a solid image pattern. The first line pattern and the second line pattern include a reference line image (color K) P having a line width equal to or less than 1 millimeter and a length equal to or more than 3 millimeters. The reference line image P is used as a reference for the position detection. The first line pattern and the second line pattern also include line images in four colors, K, Y, M, and C. The solid image pattern includes solid images in K, Y, M, and C, having a line width equal to or more than 1 millimeter. The reference line image P according to the embodiment is in the color K. However, the reference line image P can be in another color.

Next, the position detecting sensor 51 and the position detecting sensor 52 detect the failure detection pattern (S402).

The position detecting sensor 51 and the position detecting sensor 52 acquire operation control information related to the "missing pixel", operation control information related to the "pinhole", operation control information related to the "wormhole", and operation control information related to the "hat" image (S403).

First, the operation control information related to the "missing pixel" will be described. As described above, as a result of the decrease in image density caused by the deterioration of the toner and the developing unit 34, the "missing pixel" occurs in the line image, and the position measurement results vary. The operation control information related to the "missing pixel" is acquired by a study of a degree of variation in the position measurement results.

Figure 19B:
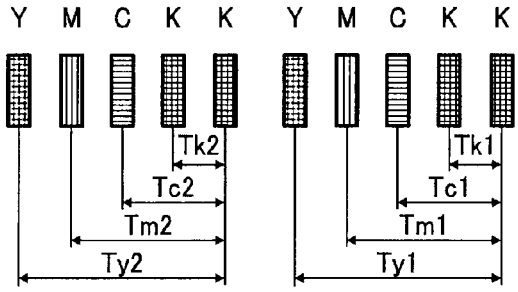
FIG. 19B is an explanatory diagram of a method of detecting position from the failure detection pattern.

Specifically, as shown in FIG. 19B, first, times are measured from when the position detecting sensor 51 and the position detecting sensor 52 detect the reference line image P to when the position detecting sensor 51 and the position detecting sensor 52 detect the line images in each color (Tk1, Tc1, Tm1, and Ty1). In other words, the Tk1, Tc1, Tm1, and Ty1 are position information of each color, based on the reference line image. Tk2, Tc2, Tm2, and Ty2 are similarly acquired from the second line image as the position information of the line images in each color. A measurement difference S (Tk1-Tk2, Tc1-Tc2, Tm1-Tm2, and Ty1-Ty2) of each color is calculated as consistency between the position information acquired from the two line image patterns. A plurality of line patterns, such as a third line pattern and a fourth line pattern, can be formed. A plurality of measurement differences can be calculated, and an average T of the measurement difference of each color and a dispersion U of the measurement differences can be calculated. The measurement difference S indicating the consistency between position information, the average T of the measurement differences, and the dispersion U of the measurement differences are used as the operation control information related to the "missing pixel" to calculate the index value C of the failure judgment.

Next, the operation control information related to "pinhole" will be described. As described above, when the "pinhole" occurs in the line image because the photoreceptor and the charging unit 32 are soiled or deteriorated, the point at which the memory value transitions from low to high is not present. The memory value is acquired from the output value outputted from the position detecting sensor 51 and the position detecting sensor 52. As a result, the L-to-H edge (where the memory value transitions from low to high) may not be detected, and the position information of the line image may not be acquired. Therefore, whether the L-to-H edge is detected is checked from the output value (memory value) outputted from the position detecting sensor 51 and the position detecting sensor 52 at a timing at which the L-to-H edge should be detected. A frequency W of when the L-to-H edge is not detected is counted for each color. When the L-to-H edge is not detected, a value of the frequency W is incremented (W=1). The frequency W is used as the operation control information related to the "pinhole" to calculate the index value C of the failure judgment.

Next, the operation control information related to the "wormhole" will be described. As described above, when the "wormhole" occurs in the line image because the toner and the transferring unit 35 are deteriorated, two peaks (where the memory value transitions from low to high) are present in two points in the output value outputted from the position detecting sensor 51 and the position detecting sensor 52. A number of times the L-to-H edge is detected (a number of times the memory value transitions from low to high) is counted from the output value (memory value) outputted from the position detecting sensor 51 and the position detecting sensor 52, at the timing at which the L-to-H edge should be detected. A frequency $X_1$ of when two L-to-H edge detections are counted is counted for each color. When two L-to-H edge detections are counted, a value of the frequency $X_1$ is incremented ($X_1$=1). The frequency $X_1$ is used as the operation control information related to the "wormhole" to calculate the index value C of the failure judgment.

Next, the operation control information related to the "hat" image will be described. As described above, when the "hat" image occurs when the solid image is formed because the developing agent is deteriorated, (where the memory value transitions from low to high) are present in two points in the output value outputted from the position detecting sensor 51 and the position detecting sensor 52. Therefore, whether the L-to-H edge has been detected at a predetermined timing is checked before the position detecting sensor 51 and the position detecting sensor 52 detect the solid image. A frequency $X_2$ of when the L-to-H edge is detected before the detection of the solid image is counted for each color. Whether the position detecting sensor 51 and the position detecting sensor 52 have detected the solid image can be determined from a number of consecutive memory values that are held high. When the L-to-H edge is detected at the predetermined timing, a value of the frequency $X_2$ is incremented ($X_2$=1). The frequency $X_2$ is used as the operation control information related to the "hat" image to calculate the index value C of the failure judgment.

The operation control information S, T, and U related to the "missing pixel", the operation control information W related to the "pinhole", the operation control information $X_1$ related to the "wormhole", and the operation control information $X_2$ related to the "hat" image are acquired from the position detecting sensor 51 and the position detecting sensor 52 in this way. Then, the emitted light amount R, the exposure light amount correction parameter P, and the correction parameter Q of the light-emitting element in the process controlling sensor 37 are read from the memory as the device operation control information (S404).

The index value C is calculated from the operation control information, and the failure judgment is made based on the index value C, as described above (S406 to S407).

The above-described failure detection pattern is used to acquire the operation control information S related to the "missing pixel", the operation control information W related to the "pinhole", the operation control information $X_1$ related to the "wormhole", and the operation control information $X_2$ related to the "hat" image. However, this is not limited thereto. For example, the failure detection pattern can be a single line pattern when the operation control information related to the "pinhole" and the operation control information related to the "wormhole" are required.

Next, the second example will be described. In the second example, the operation control information is acquired from the position detection data of the position detection pattern image 60 created during the color shifting correction control.

Figure 20:
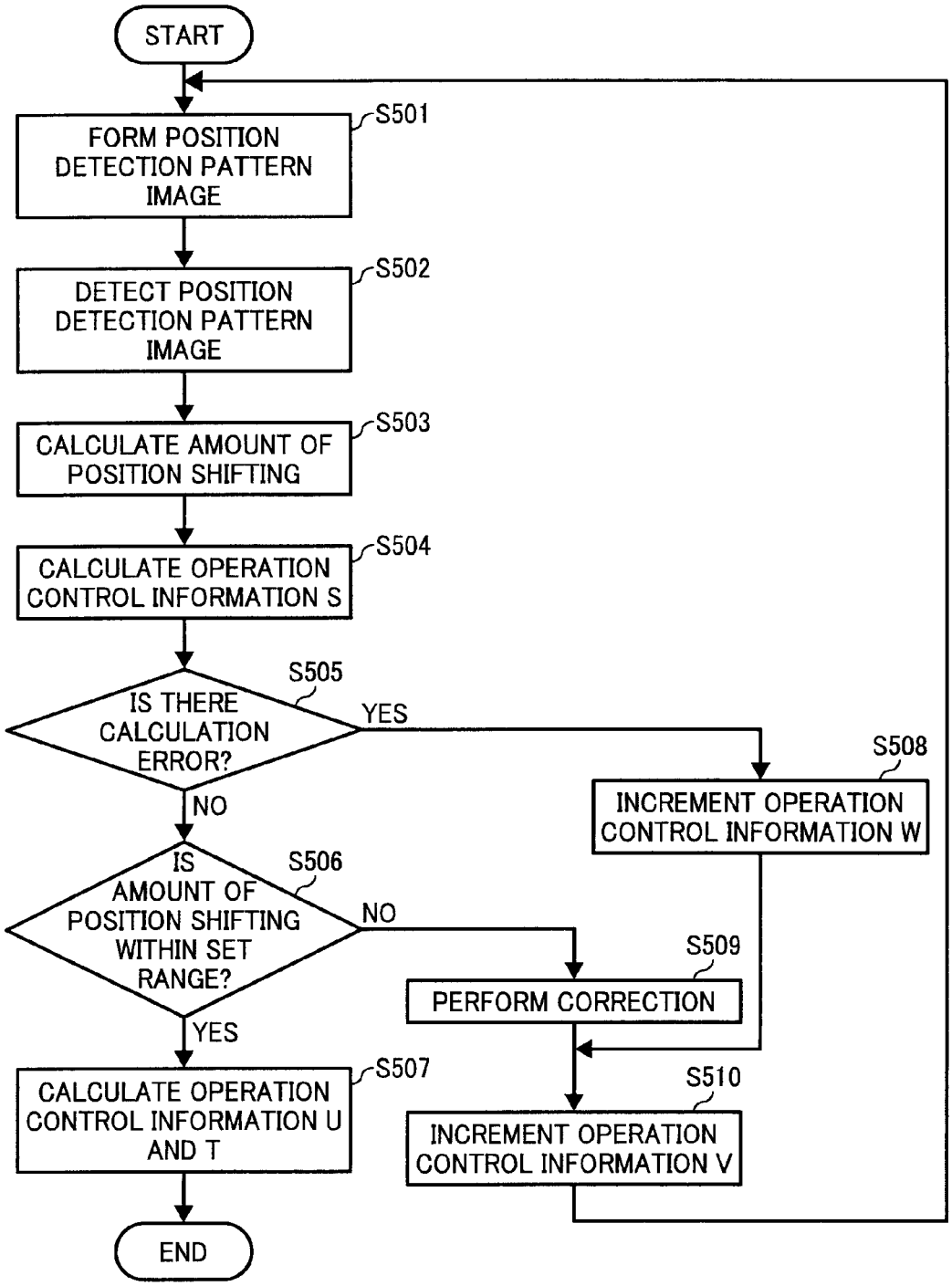
FIG. 20 is a flowchart of an acquisition of the operation control information according to a second example.

FIG. 20 is a flowchart of an acquisition of the operation control information in the second example.

First, the position detection pattern image 60, such as that shown in FIG. 7, is formed (S501). Information related to the occurrence of the "pinhole", the "wormhole", and the like can be acquired by a single pattern. However, information related to the "missing pixel" and the like can be acquired by a plurality of patterns being formed and the measurement difference S being determined. Next, the amount of position (color) shifting (skew-shifting amount, main scanning resist shifting amount, main scanning scale shifting amount, and sub-scanning resist shifting amount) is calculated from the detection results (S502) from the position detecting sensor 51 and the position detecting sensor 52 (S503). The measurement difference S serving as the operation control information is also calculated from the detection results from the position detecting sensor 51 and the position detecting sensor 52 (S504). Next, when a calculation error occurs (YES at S505), the calculation error indicates that the position detection pattern image 60 cannot be detected and the amount of position (color) shifting cannot be calculated. Therefore, the operation control information W related to the "pinhole" is incremented (S508). A retry frequency V of when a position shifting calculation process is retried is incremented (S510). Steps subsequent to S501 are performed.

At the same time, when the amount of position shifting can be calculated (NO at S505) and the amount of position shifting is not within the set range (NO at S506), the color shifting correction is performed (S509). The retry frequency V of when the position shifting calculation process is retried is incremented (S510). The steps subsequent to S501 are performed.

When the amount of position shifting is within the set range (YES at S506), the operation control information $X_1$ related to the "wormhole" is acquired from the measurement memory. The average T of the measurement difference and the dispersion U of the measurement difference are also calculated.

In this way, in the second example, the operation control information is acquired through use of the line image used in the color shifting correction control. Therefore, compared to when the color shifting correction control and the operation control information acquisition are performed separately, toner consumption can be suppressed. Compared to when the color shifting correction control and the operation control information acquisition are performed separately, an amount of time during which the image formation is interrupted can be reduced.

When the position shifting calculation process is performed a plural number of times, if the measurement difference S is calculated from the position detection information acquired when the position shifting calculation process is performed for a first time and the position detection information acquired when the position shifting calculation process is performed for a second time following the color shifting correction, the measurement difference S includes information attributing incorrect color shifting correction to a decline in position consistency accompanying image deterioration. The measurement difference S also includes information attributing the incorrect color shifting correction to an exposure optical system circuit operation that operates when the color shifting correction is performed and a driving accuracy of an actuator that adjusts an angle of an optical element. In other words, the consistency is high when the image is formed normally and the color shifting correction is performed correctly. However, the consistency is low when the image is deteriorated or when the exposure optical system circuit operation or the driving accuracy of the actuator adjusting the angle of the optical element is deteriorated as a result of wear. In this way, the information S, T, and U indicating the consistency of the position information can include information indicating why the color shifting correction has not been correctly performed. As a result, the failure judgment and the failure prediction of the exposure optical system can be performed.

To differentiate whether a failed area is the image forming unit or the exposure optical system, it is effective to add information excluding the position information consistency to the calculation equation for the state index value C and independently create a failure judgment formula for the image forming unit and a failure judgment formula for the exposure optical system.

The retry frequency V also includes the information indicating why the color shifting correction has not been correctly performed. Therefore, the retry frequency V also includes the information on the exposure optical system failure. Therefore, the retry frequency V can be used as the operation control information for the failure judgment and the failure prediction of the exposure optical system. When the device deteriorates, the position measurement results of the position detection pattern image 60 vary. Therefore, even when the color shifting correction is performed based on the position information, the color shifting correction may not be performed correctly. As a result, the retry frequency V of the color shifting correction increases. Furthermore, as a result of the device deterioration, the "pinhole" occurs in the line image, leading to a calculation error. The retry frequency V increases. The retry frequency V includes information related to the image deterioration. Therefore, a highly accurate prediction can be made as a result of the retry frequency V being used as the operation control information to calculate the index value C.

Figure 21:
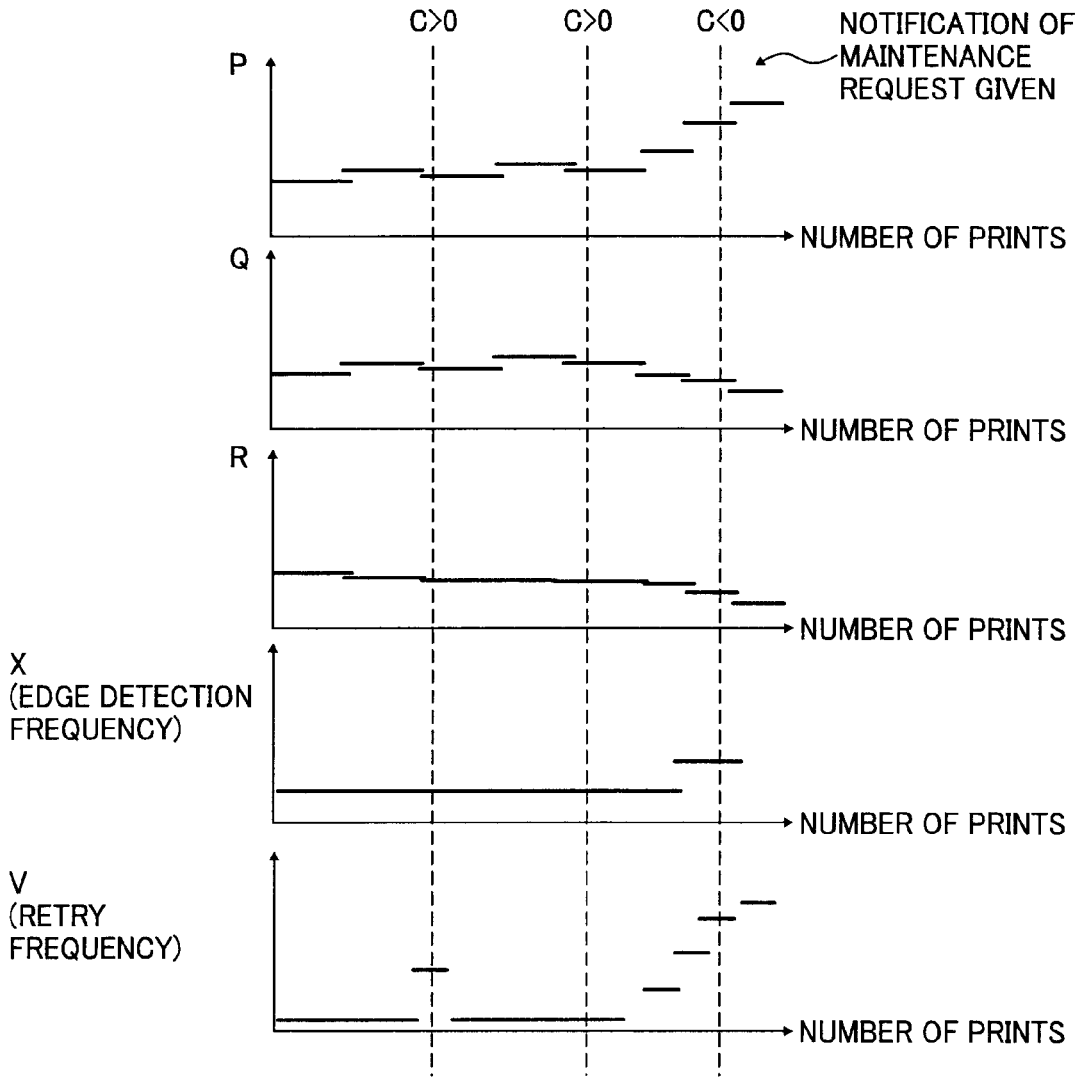
FIG. 21 is a diagram of a relationship between values P, Q, R, X, and V of operation control information and the index value C.

FIG. 21 is a diagram of a relationship between the index value C and the operation control information $X_1$ related to the "wormhole", the retry frequency V, and the operation control information P, Q, and R.

As the operation control information P, Q, and R transitions to an abnormal state, the L-to-H edge detection frequency $X_1$ and the retry frequency V also transition from the normal state to the abnormal state. Therefore, when the frequency $X_1$ of two L-to-H edge detections indicates increase and the retry frequency V indicates increase, the frequency $X_1$ and the retry frequency V are weighted so that $C<0$. As a result, the failure judgment and the failure prediction based on the index value C can be performed with higher accuracy. As a result of the increase in the pieces of operation control information used to judge the failure, the failure judgment and the failure prediction can be performed more comprehensively. Erroneous judgment caused by information on accidental failure states can be suppressed.

Errors attributed to detection location can be prevented by a plurality of process controlling sensors being disposed in the main scanning direction. In the description above, a direct reflection-type optical sensor including only a light-receiving element that receives direct reflection light is used as the process controlling sensor. However, the process controlling sensor is not limited thereto. The process controlling sensor can be a multi-type optical sensor including the light-receiving element that receives direct reflection light and a light-receiving element that receives diffused reflection light. Normally, the photoreceptor surface is very smooth. Therefore, the light reflected by the photoreceptor is the direct reflection light. However, when the photoreceptor is deteriorated and fine scratches and deposits are formed on the photoreceptor surface, the diffused reflection light increases. Therefore, through use of the multi-type optical sensor including the light-receiving element that receives diffused reflection light as the process controlling sensor, the fine scratches and deposits on the photoreceptor surface can be detected from the output value outputted from the light-receiving element that receives the diffused reflection light. The failure judgment and the failure prediction can be performed with higher accuracy when the output value outputted from the light-receiving element that receives the diffused reflection light is used as the operation controlling information.

The position detecting sensors are provided on both ends of the conveyor belt. However, this is not limited thereto. Additional position detecting sensors can be disposed in a scanning line direction, and detection errors attributed to location can be prevented.

Figure 22:
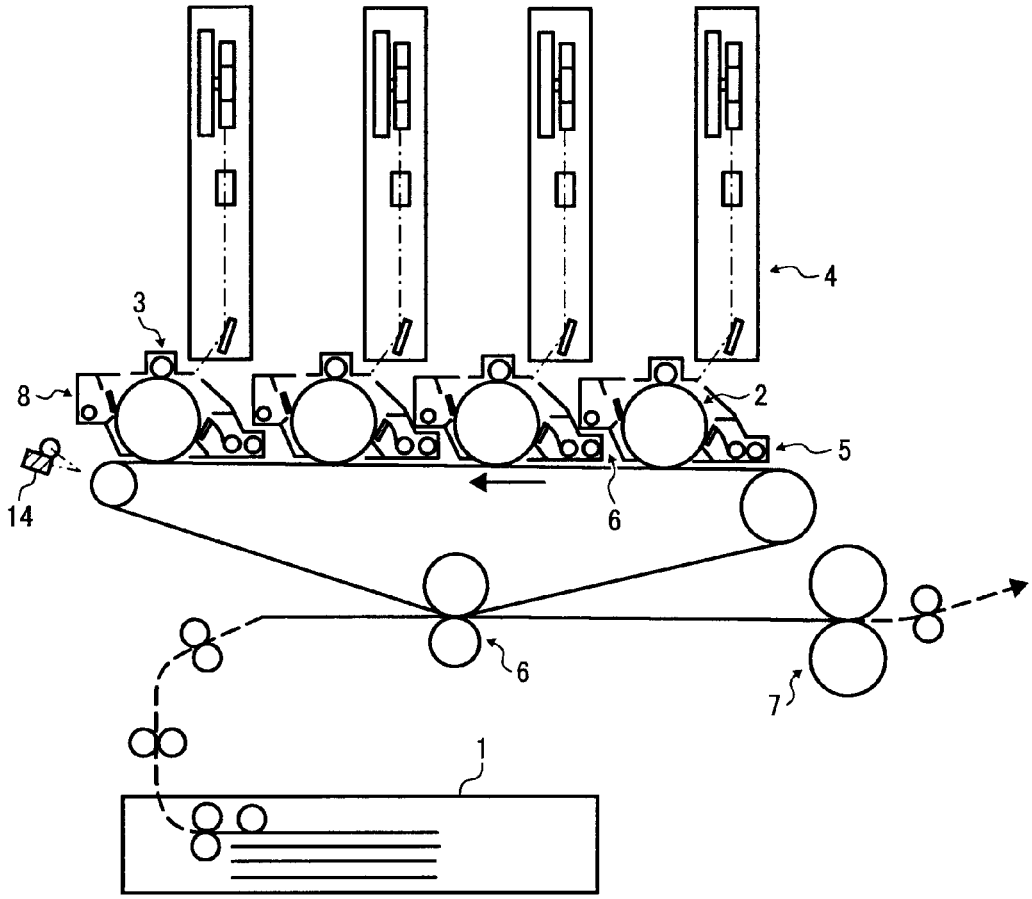
FIG. 22 is a schematic diagram of another example of an image forming apparatus according to the embodiment.

The above-described image forming apparatus is a direct-transfer type that transfers the toner images formed on the photoreceptor of each color directly onto the recording paper. However, this is not limited thereto. For example, as in FIG. 22, the image forming apparatus can be an intermediate-transfer type. The images formed on the photoreceptor of each color are intermediately transferred onto an intermediate transfer belt. Then, the images are transferred onto the recording paper.

In the intermediate-transfer-type image forming apparatus, a sensor can be provided in a position facing the intermediate transfer belt. The sensor can be used as both the process controlling sensor and the position detecting sensor. The multi-type optical sensor including the light-receiving element that receives the direct reflection light and the light-receiving element that receives the diffused reflection light is preferably used as the optical sensor that is used as both the process controlling sensor and the position detecting sensor. Between the light-receiving element that receives the diffused reflection light and the intermediate transfer belt, the slit component is provided. The diffused reflection light enters the diffused reflection light-receiving element only when the position detection pattern image reaches a position facing the diffused reflection light-receiving element. In this case, the emitted light amount R adjusted during a process control serves as the operation control information indicating a state of deterioration of the intermediate transfer belt.

Next, a second characteristic according to the embodiment will be described.

A small scratch may be accidentally formed on the photoreceptor surface during a jam clearing process operation and the like. Specifically, for example, when the sheet of recording paper is pulled out of the image forming apparatus during the jam clearing process, a wristwatch on a user's arm may accidentally rub against the photoreceptor surface. A fine scratch extending in an axial direction may be formed on the photoreceptor surface.

The toner is deposited onto the photoreceptor surface until a transfer position or a photoreceptor cleaning position is reached. Materials that are added to the toner, such as silica, titanium oxide, and wax, may adhere to the photoreceptor surface. As shown in FIG. 1, in the direct-transfer-type image forming apparatus that transfers the image formed on the photoreceptor surface directly onto the recording paper, the photoreceptor surface comes into contact with various recording papers. Therefore, calcium carbonate, silica, and the like used as coating on the recording papers may adhere to the photoreceptor surface. The material, such as silica, titanium oxide, and wax, adhered in this way may get stuck in the fine scratch extending in the axial direction, forming a small fixed core. The fixed core grows over time and with use. Filming caused by various contaminants and extending in the axial direction occurs. When the filming extending in the axial direction occurs, a horizontal streak appears in the image. The user becomes aware of the device failure (the deterioration of the photoreceptor). The device is repaired when the horizontally-streaked image appears. Therefore, the image forming apparatus continues to form the abnormal image from when the abnormality occurs to when the repair is completed. The image forming apparatus cannot form a normal image during this time and, therefore, stops functioning. As a result, the user suffers a large amount of time loss. Furthermore, when the abnormal image is formed, the image is required to be formed again. As a result, resources (toner and paper) are wasted.

The cleaning unit 36 that cleans the photoreceptor surface after the toner image is transferred uses a blade-cleaning method. In the blade-cleaning method, a tip of a polyurethane rubber blade is placed against the photoreceptor surface and cleans the photoreceptor surface. The polyurethane rubber blade is long in a direction perpendicular to a movement direction of the photoreceptor. The polyurethane rubber blade is resistant to frictional wear. However, when the polyurethane rubber blade is continuously deformed, the polyurethane rubber blade deteriorates and a fine crack is formed at the tip. When the deterioration of the polyurethane rubber blade progresses over time and with use, the crack grows and a small chip is formed on the tip. As a result, cleaning performance deteriorates in the chipped area. The silica and the toner deposited onto the photoreceptor surface slip through the chipped area. The silica and the toner that have slipped through are deposited onto the charging unit 32 in a localized area and stain the charging unit 32. Alternatively, the silica and the toner remain on the photoreceptor surface as a streak along the movement direction and stain the photoreceptor. The stains accumulate over time. Poor charging occurs in a localized area, and vertical streaks appear on the image. As a result, the user becomes aware of the device failure (the deterioration of a cleaning blade). The device is repaired when the vertically-streaked image appears. Therefore, the image forming apparatus continues to form the abnormal image from when the abnormality occurs to when the repair is completed. The image forming apparatus cannot form a normal image during this time and, therefore, stops functioning. As a result, the user suffers a large amount of time loss. Furthermore, when the abnormal image is formed, the image is required to be formed again. As a result, resources (toner and paper) are wasted.

Light irradiated onto an area of the photoreceptor on which the contaminant is deposited and an area on which the scratch is formed has more diffused and reflected components than light irradiated onto other areas. In other words, whether the scratch is formed on the photoreceptor surface and whether the contaminant is deposited onto the photoreceptor surface can be detected by detection of the reflection light of the light irradiated onto the photoreceptor surface. An effect of the degradation of the photoreceptor can be identified before the filming occurs along the scratch on the photoreceptor surface and the horizontally-streaked image appears. Moreover, an effect of the degradation of the cleaning blade can be identified before localized stains grow on the charging unit and the vertically-streaked image appears.

Therefore, the failure prediction and the failure judgment can be performed with higher accuracy through use of detection data regarding the reflection light of the light irradiated onto the photoreceptor surface. The detection data allows a state of degradation of the photoreceptor and a state of degradation of the cleaning blade to be identified before the image is affected.

A surface state detecting sensor serving as a surface state detecting unit that detects the photoreceptor surface state includes a light-emitting unit and a light-receiving unit. The light-emitting unit irradiates light onto the photoreceptor surface. The light-receiving element is a photodiode or a charge-coupled device (CCD) that receives the light reflected by the photoreceptor surface. The light-receiving element is preferably disposed in a position at which the diffused reflection light reflected by the photoreceptor surface is received, rather than the direct reflection light. Normally, the photoreceptor surface is a smooth, almost mirror-like surface. Therefore, the light reflected by the photoreceptor surface without scratches or deposits is mostly direct reflection light. When the light-receiving unit is disposed in the position at which the direct reflection light is received, the light-receiving unit receives a direct reflection light component of an area surrounding the scratch or the deposit. Therefore, the fine scratches and deposits on the photoreceptor surface cannot be detected. At the same time, when the light-receiving unit is disposed in the position at which the diffused reflection light is received, very little light enters the light-receiving unit. Therefore, even a small amount of diffused reflection light diffused and reflected by the scratch or the deposit on the photoreceptor surface can be detected. Therefore, the light-receiving unit is preferably disposed in the position at which the diffused reflection light is received.

Figure 23:
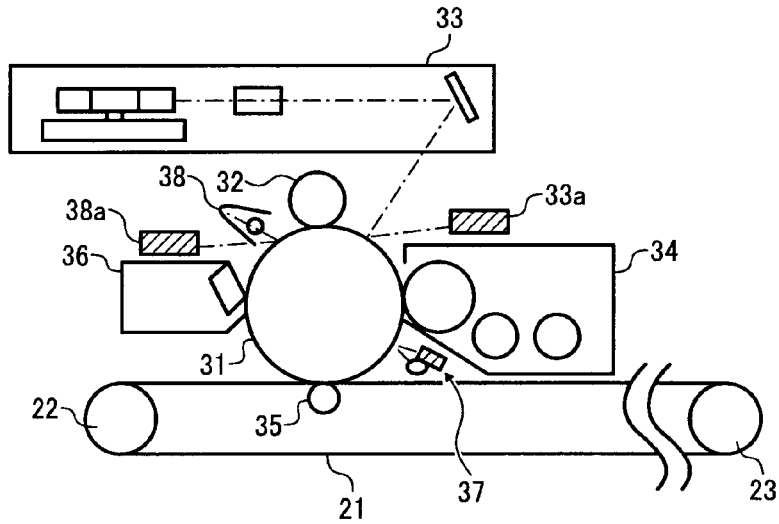
FIG. 23 is an explanatory diagram of a surface state detecting unit.

The surface state detecting unit that detects the photoreceptor surface state can also serve as the process controlling sensor 37. As shown in FIG. 23, a light-receiving unit 33*a* can be disposed in a position allowing detection of the reflection light from the photoreceptor 31 that is of a writing light irradiated toward the photoreceptor 31 from the exposure unit 33. The photoreceptor surface state can be detected by use of the light irradiated toward the photoreceptor 31 from the exposure unit 33. In other words, in this case, the exposure unit 33 functions as the surface state detecting unit. The light-receiving unit 33*a* can also be disposed in a position allowing detection of the reflection light from the photoreceptor 31 that is of a light irradiated toward the photoreceptor 31 from the erase lamp 38. The photoreceptor surface state can be detected by the use of the light irradiated toward the photoreceptor 31 from the erase lamp 38.

Next, processes used to perform the failure judgment using the detection results optically detected from the photoreceptor surface by the surface state detecting sensor will be described in detail, based on example A to example C.

First, the example A will be described.

Figure 24A:
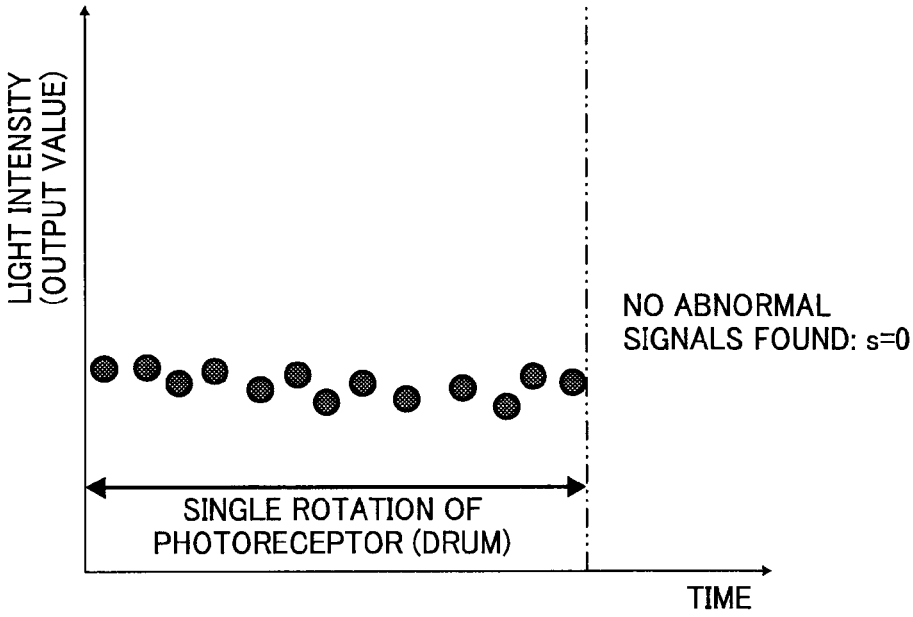
FIG. 24A is a diagram of detection data when a surface state detecting sensor continuously detects a photoreceptor surface when the photoreceptor surface has no scratches or deposits.
Figure 24B:
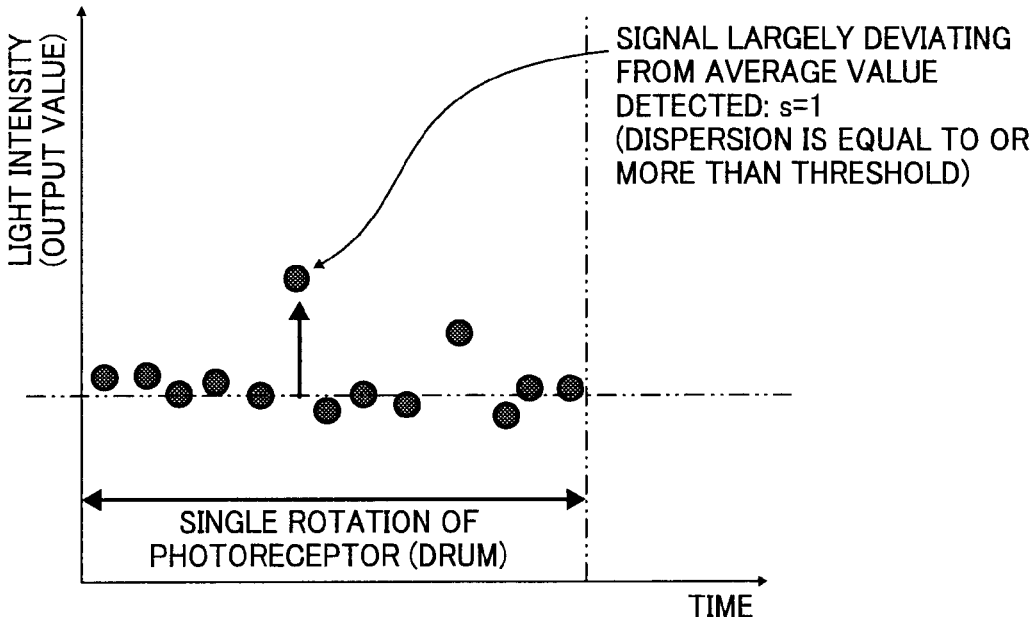
FIG. 24B is a diagram of detection data when a surface state detecting sensor continuously detects the photoreceptor surface when a portion of the photoreceptor surface has a scratch or a deposit.

FIG. 24A is a diagram of detection data (output values) when the photoreceptor surface is consecutively detected by the surface state detecting sensor when the photoreceptor surface has no scratches or deposits. FIG. 24B is a diagram of detection data (output values) when the photoreceptor surface is consecutively detected by the surface state detecting sensor when a portion of the photoreceptor surface has a scratch or a deposit. In FIG. 24A and FIG. 24B, the detection data is acquired 13 times while the photoreceptor makes a single rotation. In the example A, the process controlling sensor 37 is used as the surface state detecting sensor.

As shown in FIG. 24A, when the photoreceptor surface has no scratches or deposits, each piece of detection data indicates almost the same value. The 13 pieces of detection data acquired while the photoreceptor makes a single rotation are homogeneous. However, as shown in FIG. 24B, when a portion of the photoreceptor has the scratch or the deposit, detection data having a higher output value than other pieces of detection data is present. The detection data become nonhomogeneous. Therefore, whether the photoreceptor surface has a scratch or a deposit can be detected through a judgment of whether the detection data are homogeneous. Specifically, the system controller calculates an average value of the acquired 13 pieces of detection data and calculates a difference value between each piece of detection data and the average value. Whether the calculated difference value is within a predetermined range is detected. When the difference value is not within the predetermined range, the detection data are judged to be nonhomogeneous. A judgment value S is 1. At the same time, when all calculated difference values are within the predetermined range, the detection data are judged to be homogeneous. The judgment value S is 0.

Figure 25:
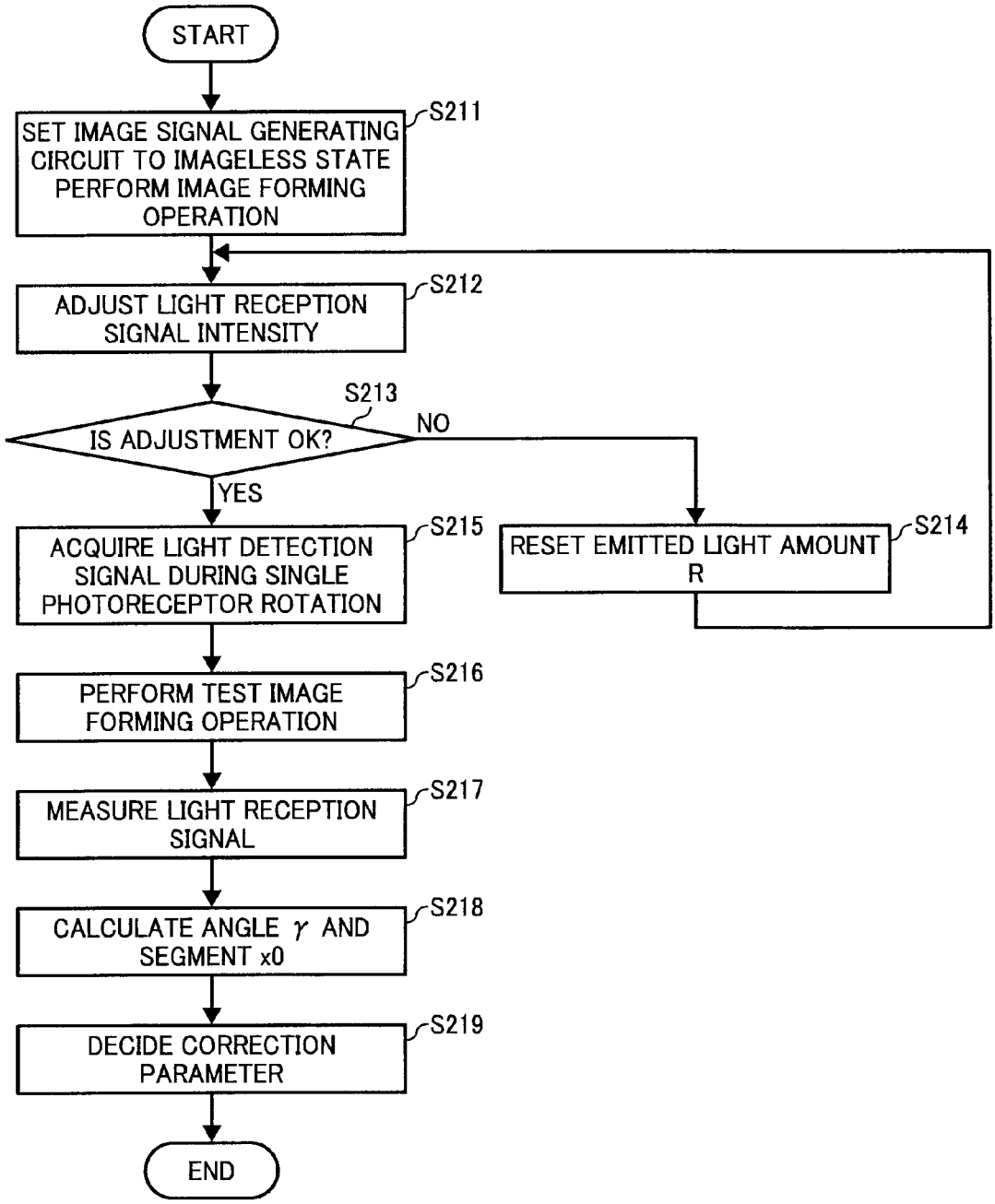
FIG. 25 is a flowchart of an acquisition of detection data of a photoreceptor surface state in an example A.

FIG. 25 is a flowchart of an acquisition of the 13 pieces of detection data regarding the photoreceptor surface state acquired while the photoreceptor makes a single rotation. The detection data regarding the photoreceptor surface state is acquired during the process adjustment operation. In other words, when the process controlling sensor 37 has completed the calibration operation (S211 to S214), a detection data group regarding the photoreceptor surface state during a single photoreceptor rotation (the 13 pieces of detection data) is acquired (S215). When the detection data group regarding the photoreceptor surface state of the single photoreceptor rotation is acquired, the certain test image is automatically formed on the photoreceptor. The process control is performed (S216 to S219).

The judgment value S changes depending on the deterioration of the photoreceptor 31 and the deterioration of the cleaning blade. However, when the failure judgment is made by the use of only the judgment value S, there is risk of an erroneous judgment. For example, a state in which dust is attached to the photoreceptor surface is judged as the failure. When a failure judgment such as this is made in the actual device, false alarms occur with great frequency. As a result, the image forming apparatus cannot be operated and becomes useless. Therefore, the failure judgment that takes the judgment value S and the three values, P (exposure light amount correction parameter), Q (correction parameter), and R (emitted light amount), into general consideration is performed. P. Q. and R are invaluable for the above-described failure judgment.

The failure judgment using the values S, P, Q, and R as the operation control information will be described.

Figure 26:
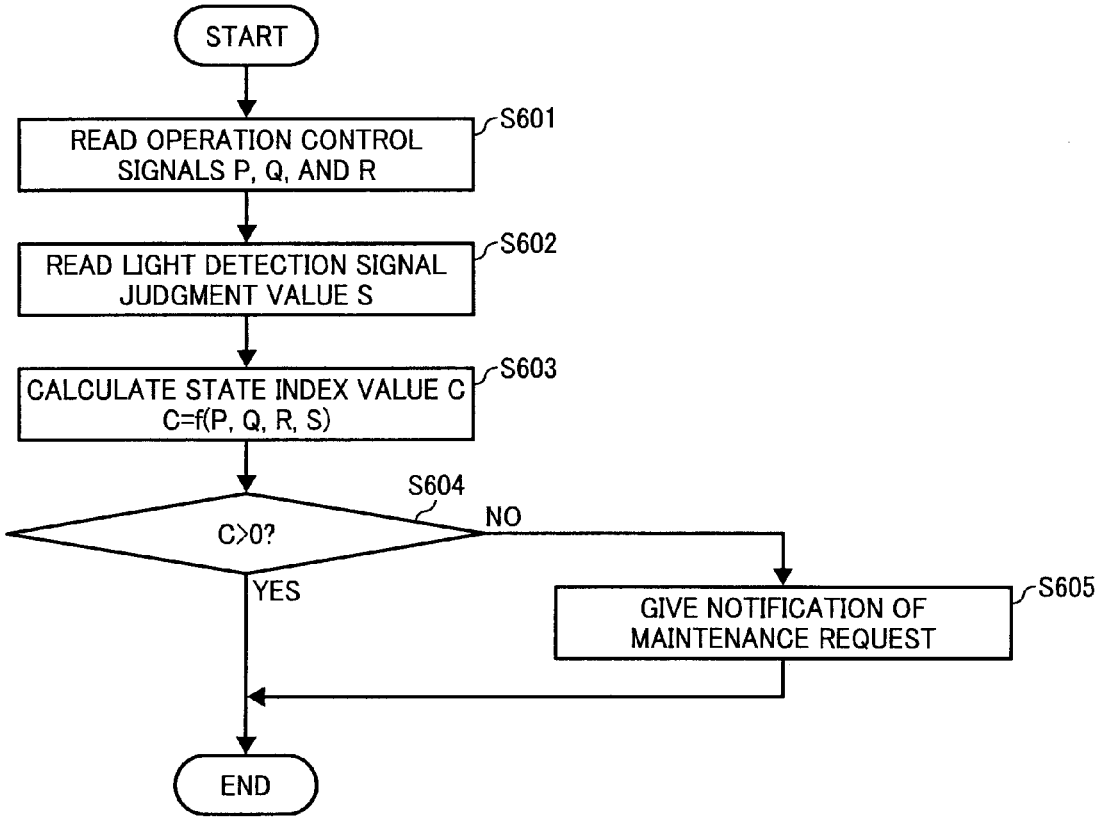
FIG. 26 is a flowchart of a failure judgment performed using values S, P, Q, and R as operation control information.

FIG. 26 is a flowchart of the failure judgment performed using the values S, P, Q, and R as the operation control information.

The emitted light amount R, the exposure light amount correction parameter P, the correction parameter Q, and the judgment value S of the light-emitting element in the process controlling sensor 37 are read from the memory as the device operation control information (S601 to S602). From the operation control information, the index value C is calculated as described above (S603). The failure judgment is made based on the index value C (S604 to S605).

When the first-order linear combination equation is used as the calculation equation for calculating the index value C, $C=aP+bQ+cR+dS$. The weighted parameters a, b, c, and d are determined using, for example, the pattern recognition algorithm, as described above.

Figure 27:
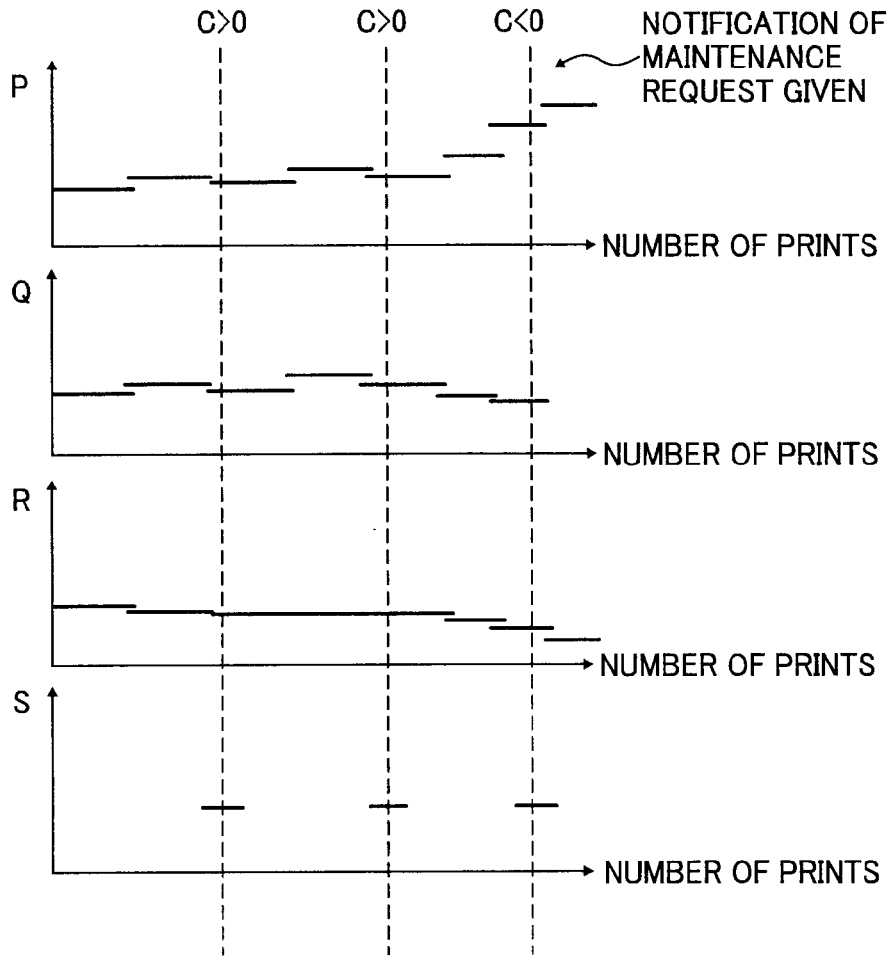
FIG. 27 is a diagram of an example of a relationship between values P, Q, R, and S of the operation control information and the index value C.

FIG. 27 is a diagram of an example of a relationship between the index value C and the values P, Q, R, and S of the operation control information.

Among three instances in which S=1, two instances on the left show only slight changes in the P, Q, and R from a normal range of change. Development capability changes when the photoreceptor surface state changes. Therefore, all of the values P, Q, and R may change. However, when S is 1 when there is no change, as in the two instances on the left, C>0. At the same time, as in an instance on the right, the weighted parameters of the first-order linear combination equation are selected so that C<O when S is 1 and all of the values P, Q, and R have changed. The failure judgment with practical benefits can be performed by such device operation control information being taken into general consideration. The output result of the image is not measured. Instead, the change in the photoreceptor surface state is measured. Therefore, a state in which the abnormal image is not formed but the surface is starting to deteriorate can be detected. Therefore, the failure can be predicted.

As a result, maintenance of the device can be performed before the abnormal image is formed. The device is not required to stop functioning. Device downtime can be controlled. Repeated image formation caused by the horizontally-streaked image and the vertically-streaked image being formed is not required to be performed. Resources (toner and paper) are not wasted, and maintenance can be planned. Time and resources required to recover from the failure can be saved.

Next, the example B will be described.

Figure 28:
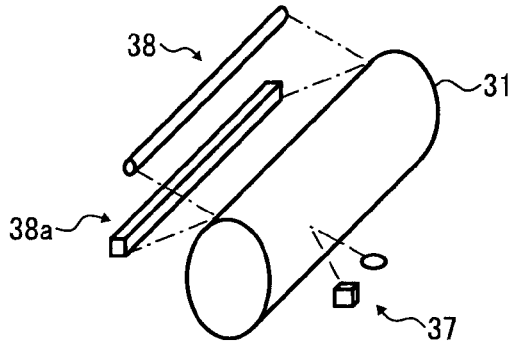
FIG. 28 is a schematic perspective diagram of main components near a photoreceptor.

As shown in FIG. 28, when the process controlling sensor 37 is used as the surface state detecting sensor, the photoreceptor surface state of only a portion of the photoreceptor surface in the axial direction can be detected. In particular, the process controlling sensor 37 may not detect a scratch formed along a photoreceptor surface movement direction or a deposit extending along the photoreceptor surface movement direction caused by the deterioration of the cleaning blade.

Therefore, in the example B, the surface state detecting sensor is a line CCD 38*a*. In the line CCD 38, CCD that is the light-receiving unit is arrayed in an axial direction of the photoreceptor. The CCD can comprehensively detect the photoreceptor surface in the photoreceptor axial direction. In FIG. 28, the line CCD 38*a* is disposed in the position allowing the detection of the reflection light from the photoreceptor surface that is of the light irradiated from the erase lamp 38. The line CCD 38*a* can also be disposed in a position allowing the detection of the reflection light of the writing light from the photoreceptor surface. The photodiode serving as the light-receiving unit can also be arrayed in the axial direction of the photoreceptor.

Figure 29A:
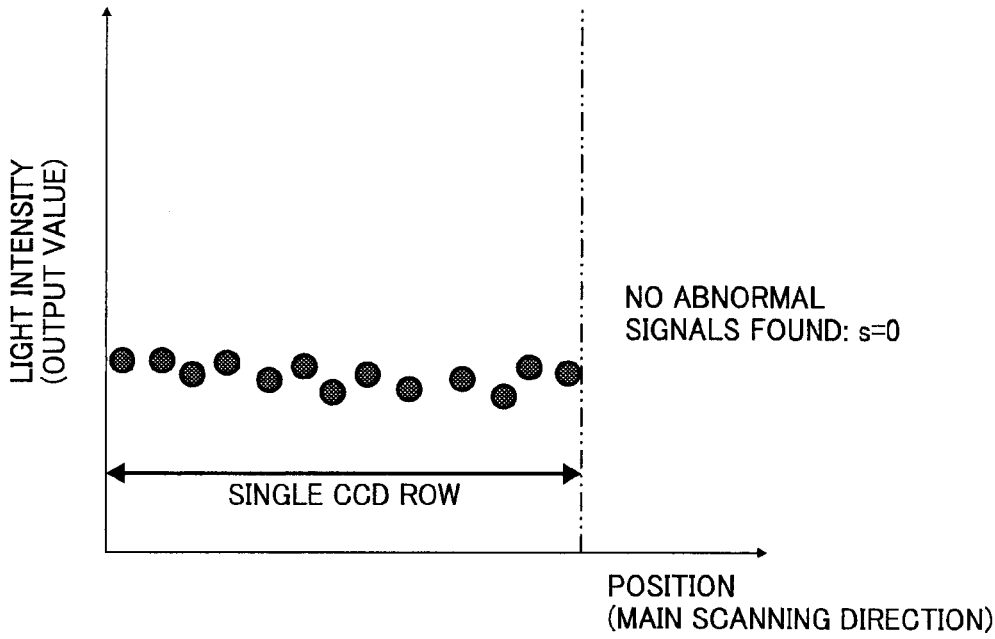
FIG. 29A is detection data when a line CCD detects a surface having no scratches or deposits.
Figure 29B:
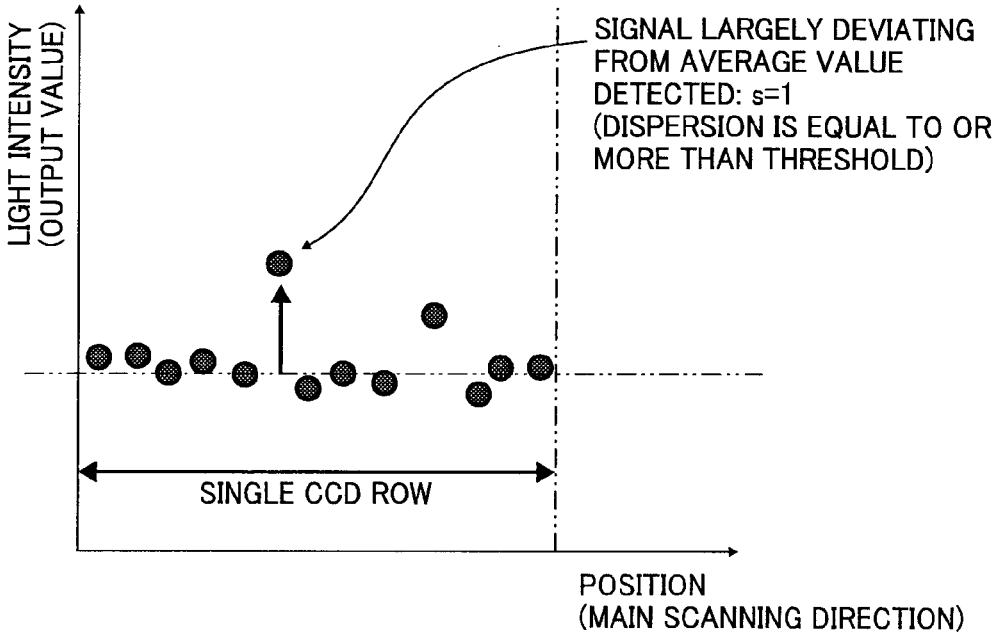
FIG. 29B is detection data when the line CCD detects a surface having a scratch or a deposit formation in a portion of the surface in an axis direction (main scanning direction) of the photoreceptor.

FIG. 29A is a diagram of detection data (output values) when the line CCD detects a surface without scratches or deposits. FIG. 29B is a diagram of the detection data (output values) when the line CCD detects a surface of which a portion in the axial direction of the photoreceptor (the main scanning direction) has a scratch or a deposit.

As shown in FIG. 29A, detection data (output value) of each CCD when the surface without scratches or deposits is detected is homogenous. At the same time, as shown in FIG. 29B, when the line CCD 38*a* detects the surface of which the portion has the scratch or the deposit in the axial direction of the photoreceptor, the detection data (output value) of some CCD is higher than that of other CCD. As a result, the detection data of each CCD becomes nonhomogeneous. Therefore, whether the photoreceptor surface has the scratch or the deposit can be detected by a judgment of whether the detection data acquired from each CCD are homogeneous. Specifically, the system controller calculates the average value based on the detection data acquired from each CCD. Then, the system controller calculates a difference value between the detection data from each CCD and the average value. Whether the calculated difference value is within a predetermined range is detected. When the difference value is not within the predetermined range, the detection data from each CCD are judged to be nonhomogeneous. The judgment value S is 1. At the same time, when all calculated difference values are within the predetermined range, the detection data from each CCD are judged to be homogeneous. The judgment value S is 0.

Figure 30:
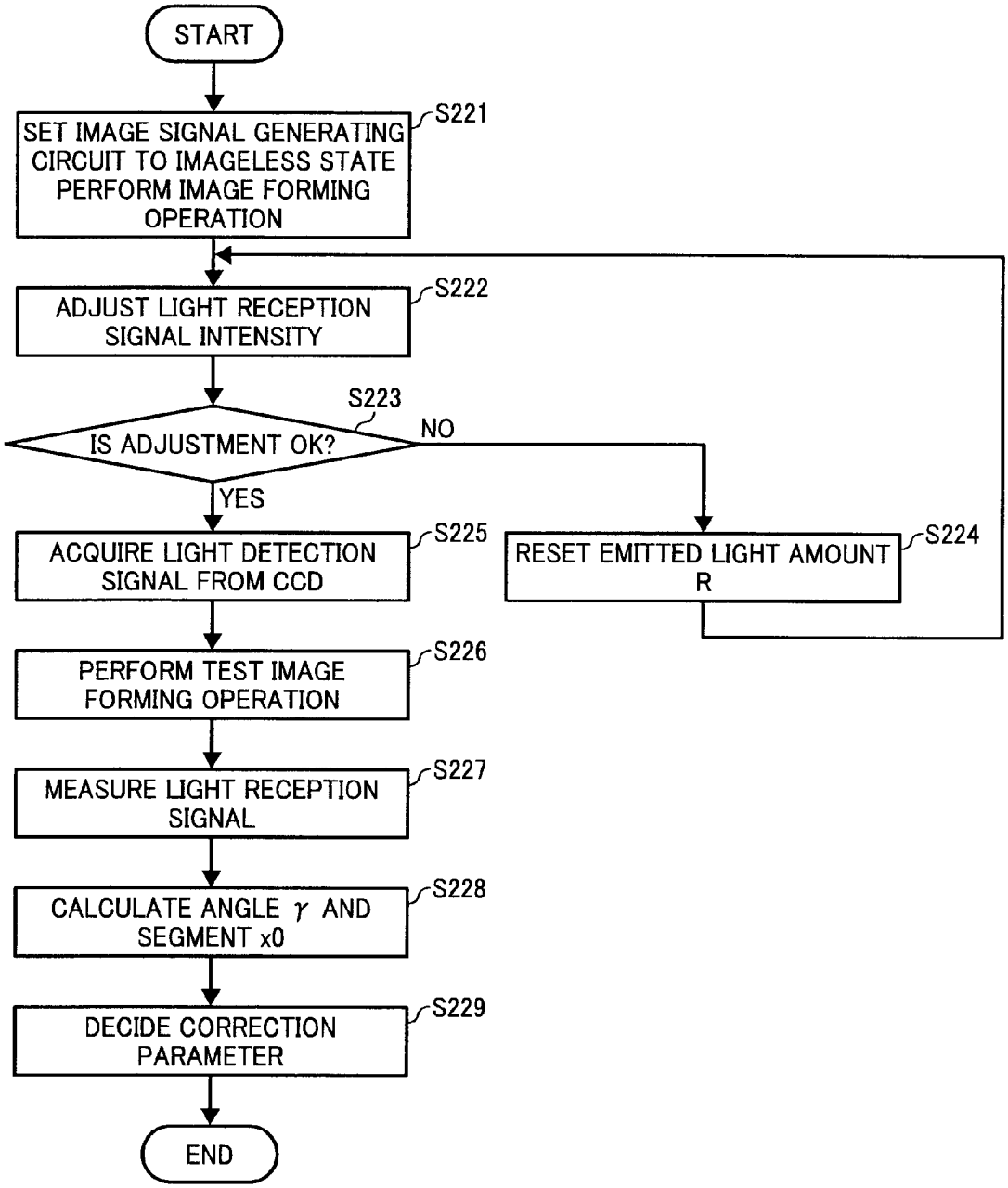
FIG. 30 is a flowchart of an acquisition of detection data of a photoreceptor surface state in an example B.

FIG. 30 is a flowchart of an acquisition of the detection data regarding the photoreceptor surface state in the example B. In the example B, as well, the detection data regarding the photoreceptor surface state is acquired during the process adjustment operation. In other words, when the calibration operation by the process controlling sensor 37 is completed (S221 to S224), a detection data group from a single line CCD row during the single photoreceptor rotation is acquired (S225).

Whether the detection data are homogeneous is judged for each detection data group of the single line CCD row. When the detection data are judged to be homogenous, the certain test image is automatically formed on the photoreceptor. The process control is performed (S226 to S229).

The failure judgment in the example B is performed following a same process as that in the flowchart in FIG. 26. In other words, the index value C is calculated using the values P, Q, and R and the difference value S acquired from the detection data of the single line CCD 38*a* row. The failure judgment and the failure prediction are performed based on the calculated index value C.

Next, the example C will be described.

In the above-described example A and example B, localized scratches and deposits on the photoreceptor surface can be detected. However, when scratches or a deposit is evenly formed on an entire photoreceptor surface, the scratches and the deposit cannot be detected in the example A and the example B. In example C, a rare occurrence of the scratches and the deposit being evenly formed on the entire photoreceptor surface can be detected.

Figure 31:
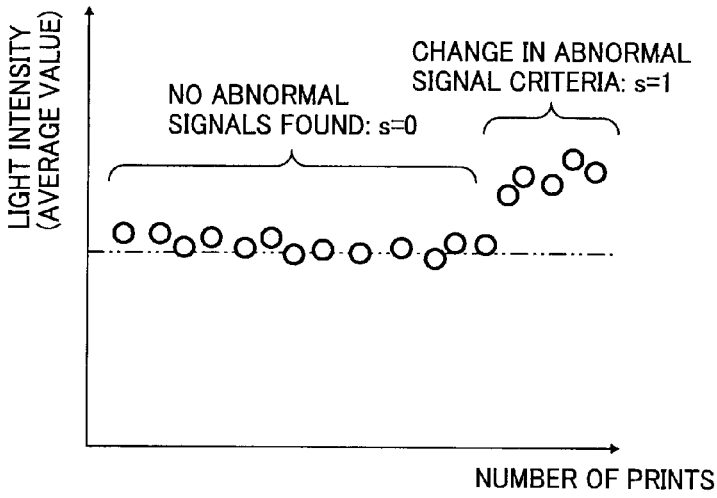
FIG. 31 is a diagram of a relationship between a number of prints and an average value of a detection data group from the line CCD.

FIG. 31 is a diagram of a relationship between the number of prints and an average value of the detection data group from the line CCD 38*a*. At an initial stage, the average value is a close to a predetermined value. However, the average value increases when deterioration progresses over time and the scratch or the deposit is formed on a portion of the photoreceptor surface or over the entire photoreceptor surface. Therefore, whether the scratch or the deposit is formed on a portion of the photoreceptor surface or over the entire photoreceptor surface can be detected by a judgment of whether the average value of the detection data is within the predetermined range.

Figure 32:
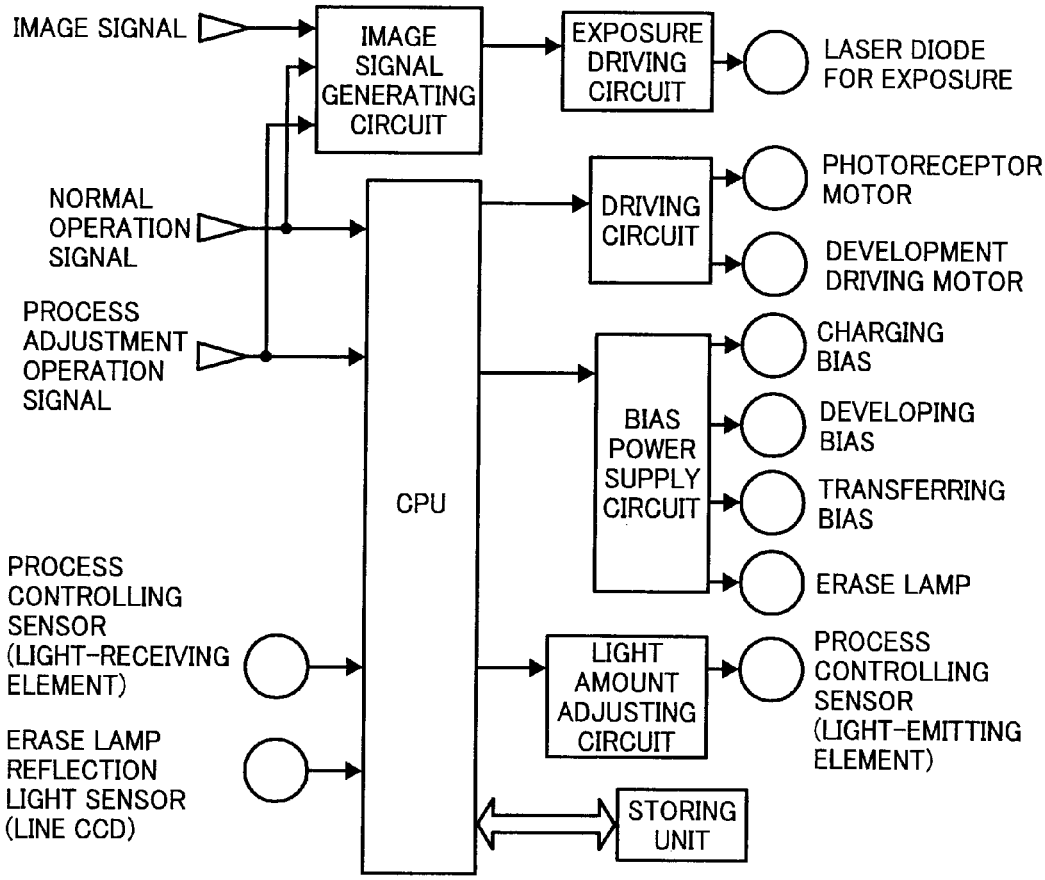
FIG. 32 is a block diagram of main components of a system controller in an image forming apparatus in an example C.

FIG. 32 is a block diagram of main components of a system controller in the example C. The system controller includes a storing unit that stores the detection data detected by the process controlling sensor during the single photoreceptor rotation and the average value of the detection data detected by the line CCD. When a new piece of detection data is acquired, the system controller determines the difference value between the newly acquired detection data and the detection data stored in the storing unit. When the difference value is equal to or more than a predetermined value, a judgment value S2 is 1. At the same time, when the difference value is less than the predetermined value, the judgment value S2 is 0.

Figure 33:
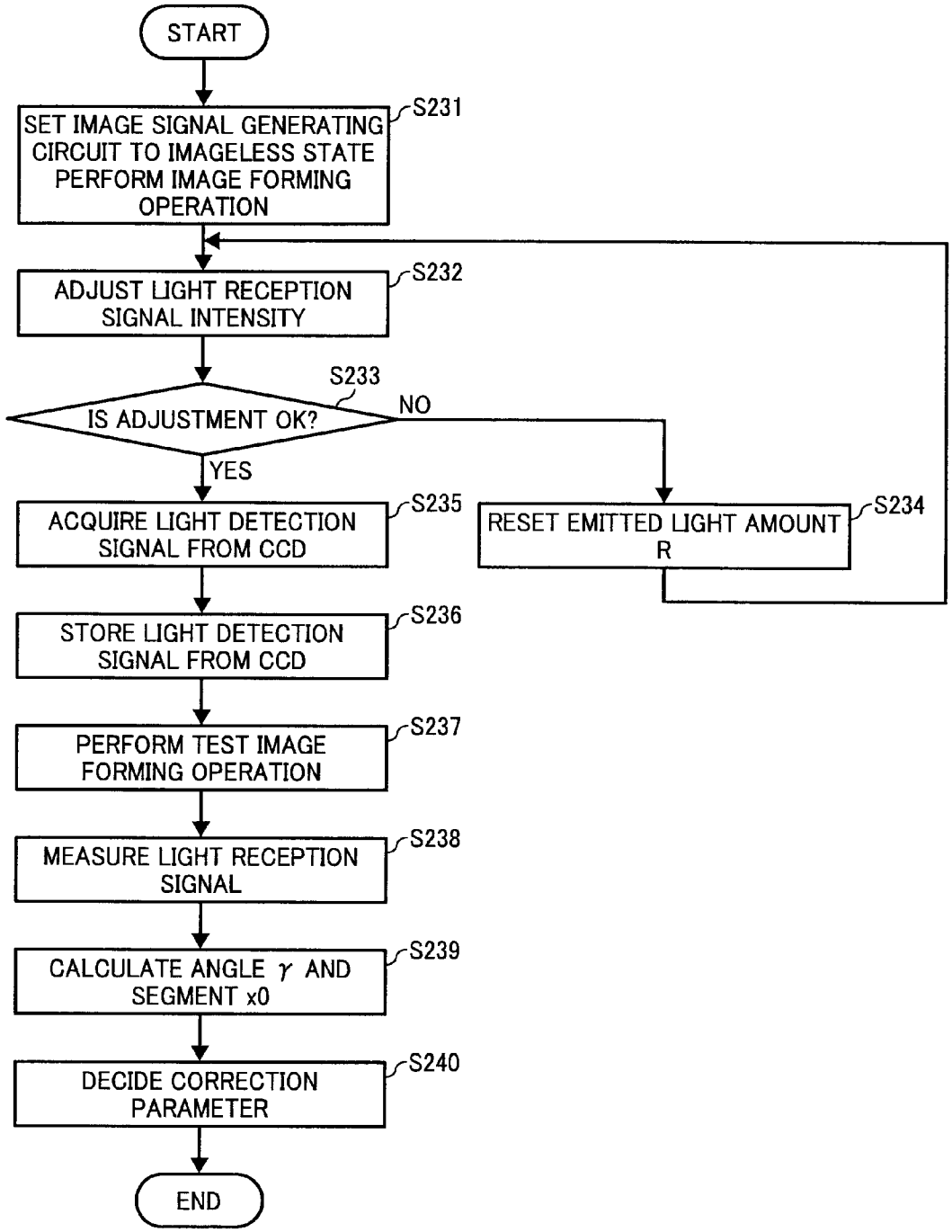
FIG. 33 is a flowchart of an acquisition of detection data of a photoreceptor surface state in the example C.

FIG. 33 is a flowchart of an acquisition of the detection data regarding the photoreceptor surface state in the example C. In the example C, as well, the detection data regarding the photoreceptor surface state is acquired during the process adjustment operation. In other words, when the calibration operation by the process controlling sensor 37 is completed (S231 to S244), the detection data is acquired during the single photoreceptor rotation (S235). Whether the acquired detection data is equal to or more than the predetermined value is judged by the acquired detection data and the detection data stored in the storing unit being compared. When the judgment is performed, the acquired detection data is stored in the storing unit (S236). Then, the certain test image is automatically formed on the photoreceptor. The process control is performed (S237 to S240).

The failure judgment in the example C is performed following the same procedure as that in the flowchart in FIG. 26. In other words, the index value C is calculated using P, Q, and R and the acquired difference value S2. The failure judgment and the failure prediction are performed based on the calculated index value C.

The example A to example C describe when the failure judgment and the failure prediction are performed using the photoreceptor surface state as the operation information. The photoreceptor serves as the image carrier. However, the failure judgment and the failure prediction can be performed through use of an intermediate transfer belt surface state as the operation information. In this case, the position detecting sensors 51 and 52 can be used as the surface state detecting sensor detecting the surface state of the intermediate transfer belt.

In the image forming apparatus according to the embodiment, the failure prediction and the failure detection can be performed with high accuracy using the device operation control information. The device control information is based on the position detection data (the output values outputted from the position detecting sensor) of the detection pattern including deterioration information regarding the toner, the photoreceptor, the charging unit, the developing unit, the transferring unit, and the like.

When the "missing pixel" occurs in the detection pattern as a result of the decrease in the density due to the deterioration of the toner and the developing unit 34, the position measuring results of the detection pattern vary. Therefore, a plurality of detection pattern images is formed. The position detecting sensor acquires the position data of each detection pattern image. The position of each detection pattern image is measured. As characteristic values indicating the consistency between each of the measured position measurement results, the measurement difference S, the average value T of the measurement difference, and the dispersion U of the measurement difference are calculated. The index value C is calculated using the measurement difference S, the average value T of the measurement difference, and the dispersion U of the measurement difference as the operation control information. As a result, the index value C including the information on the deterioration of the toner and the developing unit can be calculated. The failure judgment and the failure prediction can be performed with high accuracy based on the index value C.

As shown in the second example, the operation control information is acquired from the position detection data of the detection pattern acquired during the color shifting correction control. Therefore, compared to when the color shifting correction control and the operation control information acquisition are performed separately, toner consumption can be suppressed. Compared to when the color shifting correction control and the operation control information acquisition are performed separately, the amount of time during which the image formation is interrupted can be reduced.

The position information of the detection pattern image after the color shifting correction includes information related to the exposure optical system circuit operation that operates when the color shifting correction is performed and the driving accuracy of the actuator that adjusts the angle of the optical element. If the position information of the detection pattern image after the color shifting correction is used for the calculation of the consistency of information based on the position detection data, the information related to the driving accuracy of the actuator adjusting the angle of the optical elements can be included in the calculation result of the consistency. Therefore, by the information on the consistency being used as the operation control information, the index value C taking into consideration the information related to the exposure optical system circuit operation and the driving accuracy of the actuator adjusting the angle of the optical elements can be calculated. As a result, the device failure prediction and the device failure judgment can be performed with higher accuracy.

The retry frequency V that is the information indicating that the color shifting correction process has been retried is used as the operation control information in the calculation of the index value C. When the color shifting correction is not performed correctly, the retry frequency V increases. Therefore, the retry frequency V includes the information on the failure of the exposure optical system performing the color shifting correction. The color shifting correction process is retried when the "pinhole" occurs in the detection pattern image and the amount of color shifting cannot be calculated. Therefore, the retry frequency V increases. In other words, the retry frequency V includes the image deterioration information. The retry frequency V including the image deterioration information and the information on the exposure optical system failure is used as the operation control information in the calculation of the index value C. As a result, the device failure prediction and the device failure judgment based on the index value C can be performed with higher accuracy.

Compared to the center area of the toner image, the edge area of the toner image is easily changed by various changes in image formation conditions. The line width of the line image is narrow, from 0.1 millimeter to 1 millimeter. Therefore, the line image is significantly affected by the changes in the edge area. In the line image, the abnormal image becomes noticeable as a result of the edge area. Therefore, the failure judgment and the failure prediction can be performed with higher accuracy if the detection pattern image is the line image with a line width from 0.1 millimeter to 1 millimeter.

The "hat" image can be detected if the detection pattern image is the solid image having a line width equal to or more than 1 millimeter. The failure judgment and the failure prediction can be performed with higher accuracy.

The information acquired from the position detection data of the detection pattern that is the solid image and the information acquired from the position detection data of the detection pattern that is the line image are used as the device operation control information. Therefore, the index value C is calculated based on the information on the abnormal image acquired by the detection of the line image and the information on the abnormal image acquired by the detection of the solid image. Therefore, the failure judgment and the failure prediction based on the index value C can be performed with high accuracy.

When the position detecting sensor detects the abnormal image called the "wormhole" or the "hat", the sensor output has two peak values. Therefore, information regarding whether the abnormal image called the "wormhole" or the "hat" is formed can be acquired from the information on the peak values of the sensor output. Through the use of the information as the operation control information, the index value C can be calculated taking into consideration the information on whether the abnormal image called the "worm-hole" or the "hat" is formed.

The position detecting sensor serving as the detection pattern position detecting unit includes the light-emitting element, the slit component, and the light-receiving element. The light-emitting element emits light. The slit component has a slit having a same width as that of the line width of the detection pattern. The light-receiving element receives light emitted from the light-emitting element that has passed through the slit component. As a result, even when the sensor is cheap and has poor light-receiving sensitivity, the sensor can accurately detect the position of the detection pattern.

The detection data of the reflection light reflected by the photoreceptor surface, including information on the deterioration of the photoreceptor serving as the image carrier, is used as the device operation control information to calculate the index value C. As a result, the failure prediction and abnormality judgment can be performed with high accuracy.

As shown in the example A, the light reflected by the photoreceptor surface is consecutively detected over a predetermined period of time. Based on the detection data group acquired consecutively, the judgment value S indicating whether the detection data are homogeneous is determined. The index value C is calculated using the judgment value S as the device operation information. When the photoreceptor surface has no scratches or deposits, there is little difference in the consecutively acquired detection data group. The result is that the detection data are homogeneous. At the same time, when a portion of the photoreceptor surface has a scratch or a deposit, the reflection light component of when the light is reflected by the scratch or the deposit differs from the reflection light component of when the photoreceptor surface has no scratches or deposits. Therefore, the detection data differs from the normal detection data. Therefore, there is a difference in the consecutively acquired detection data group. The result is that the detection data are nonhomogeneous. The judgment value S indicating whether the judged detection data are homogenous, based on the detection data group acquired by the light reflected by the photoreceptor surface being consecutively detected for the predetermined period, includes information on the deterioration of the photoreceptor and the like. Therefore, through the use of the judgment value S as the operation control information, the index value C taking into consideration the surface state of the photoreceptor can be calculated.

As shown in the example B, the light-receiving units are disposed in different positions in the axial direction of the photoreceptor. The judgment value S1 indicating whether the detection data are homogenous is determined from the detection data of each light-receiving unit. The index value C is calculated using the judgment value S1 as the device operation control information. In this way, by the light-receiving units being disposed in different positions in the axial direction of the photoreceptor, the photoreceptor surface state can be comprehensively detected. The scratches and deposits formed on the photoreceptor surface can be detected with high accuracy.

As shown in the example C, the detection data newly acquired after a predetermined period of time has elapsed since the acquisition of the detection data stored in the storing unit is compared with the detection data stored in the storing unit. The comparison result is used as the device operation control information. As a result, the scratches and deposits on the entire photoreceptor surface that cannot be detected in the example A and the example B can be detected.

The light-receiving unit is disposed in the position at which the diffused reflection light diffused and reflected by the photoreceptor surface is received. Therefore, compared to when the light-receiving unit is disposed in the position at which the direct reflection light reflected by the photoreceptor surface is received, fine scratches and deposits on the photoreceptor surface can be detected.

Through the use of the erase lamp as the light-emitting unit, the cost of the device can be reduced and the device can be made more compact, compared to when a light-emitting unit other than the erase lamp is provided.

When the exposure unit serving as a latent image forming unit is used as the light-emitting unit, the cost of the device can be reduced and the device can be made more compact.

The process controlling sensor serving as the toner density detecting unit can be used as the surface state detecting sensor serving as the surface state detecting unit that detects the photoreceptor surface state. As a result, the cost of the apparatus can be reduced and the apparatus can be made more compact, compared to when the surfaces state detecting sensor and the process controlling sensor are provided separately.

When the position detecting sensor serving as the detection pattern position detecting unit is used as the surface state detecting sensor, the cost of the apparatus can be reduced and the apparatus can be made more compact.

The calculation equation determined based on the pattern recognition algorithm is used to calculate the index value C. Through the use of the pattern recognition algorithm, the calculation equation with practical benefits can be decided if the pieces of operation control information (P, Q, and R) and judgment information regarding the current photoreceptor surface state (information stating whether the photoreceptor surface state is OK or not OK) obtained from a specialist are available. In other words, through use of the pattern recognition algorithm, the calculation equation with practical benefits can be decided even when the cause-and-effect relationship between the operation control information and the failure is unknown.

In the invention, the device failure is predicted based on the index value indicating a device state acquired from a plurality of pieces of operation control information. Therefore, the failure can be comprehensively judged and predicted from the pieces of operation control information. The failure prediction can be performed with higher accuracy, compared to when the failure is predicted based on a single piece of operation control information. Because the device failure is predicted with high accuracy, the deteriorated component can be replaced and the apparatus can be repaired before the device failure occurs and the abnormal image is formed. A state in which a normal image formation cannot be performed is prevented, and the device downtime can be prevented.

Information based on the position detection data of the detection pattern, including the information on the deterioration of the toner, the photoreceptor, the charging unit, the developing unit, the transferring unit, and the like, is used as the operation control information of the apparatus. Therefore, the failure judgment and the failure prediction can be performed with high accuracy.

In the invention, the device failure is predicted based on the index value indicating an apparatus state acquired from a plurality of pieces of operation control information. Therefore, the failure can be comprehensively judged and predicted from the pieces of operation control information. The failure prediction can be performed with higher accuracy, compared to when the failure is predicted based on a single piece of operation control information. Because the device failure is predicted with high accuracy, the deteriorated component can be replaced and the apparatus can be repaired before the device failure occurs and the abnormal image is formed. A state in which a normal image formation cannot be performed is prevented, and the device downtime can be prevented.

The index value is calculated using the detection data of the reflection light reflected by the image carrier surface including the information on the deterioration of the image carrier, as the operation control information of the apparatus. Therefore, the failure judgment and the failure prediction can be performed with high accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an acquiring unit that acquires a plurality of types of operation control information of the image forming apparatus, the operation control information indicating a deterioration of a toner in the image forming apparatus or a deterioration of a component of the image forming apparatus;

an index value calculating unit that calculates an index value indicating a state of the image forming apparatus based on acquired operation control information;

an abnormality judging unit that judges whether an abnormality has occurred in the image forming apparatus or predicts an occurrence of a failure that requires a maintenance of the image forming apparatus due to the deterioration of the toner or the deterioration of the component based on calculated index value; and a detection pattern position detecting unit that detects a position of a detection pattern formed directly on an image carrier, and outputs position detection data, wherein the acquiring unit acquires various types of information contained in the position detection data as the types of operation control information, wherein the detection pattern includes a first line pattern, a second line pattern, and a solid image pattern, wherein the image carrier is a conveyor member that carries a recording paper onto which toner images are transferred, and wherein the index value calculating unit counts a number of peaks in the position detection data to determine the index value.

2. The image forming apparatus according to claim 1, wherein a plurality of pieces of position detection data are acquired;

information consistency based on each piece of position detection data is calculated; and the index value calculating unit uses the calculated information consistency as the operation control information of the image forming apparatus.

3. The image forming apparatus according to claim 1, further comprising:

an image forming unit that forms a toner image in a plurality of colors on the image carrier; and a color shifting correction controlling unit that forms a detection pattern in each color on the image carrier, uses the detection pattern position detecting unit to detect a position of the detection pattern in each color formed on the image carrier, calculates an amount of color shifting based on position detection data of the detection pattern in each color, and performs color shifting correction based on the amount of color shifting, wherein the index value calculating unit uses information that is obtained based on the position detection data of the detection pattern and that is acquired during a control of the color shifting correction, as the operation control information of the image forming apparatus.

4. The image forming apparatus according to claim 3, wherein the color shifting correction controlling unit repeats a process of forming the detection pattern in each color, using the detection pattern position detecting unit to detect the position of the detection pattern in each color formed on the image carrier, and calculating the amount of color shifting based on the position detection data of the detection pattern in each color, after performing the color shifting correction based on the calculated amount of color shifting, and information based on the position detection data of the detection position acquired after the color shifting correction is performed is used to calculate the information consistency based on the position detection data.

5. The image forming apparatus according to claim 4, wherein the color shifting correction controlling unit repeats a process of detecting the position of the detection pattern and calculating the amount of color shifting and performs the color shifting correction, when the calculated amount of color shifting is equal to or more than a predetermined amount of shifting or when an error in the calculation of the amount of color shifting occurs; and the index value calculating unit uses information indicating that the color shifting correction process has been repeated as the operation control information of the image forming apparatus.

6. The image forming apparatus according to claim 1, wherein the detection pattern image is a line image having a line width not less than 0.1 millimeter and not more than 1 millimeter.

7. The image forming apparatus according to claim 1, wherein the detection pattern image is a solid image having a line width equal to or more than 1 millimeter.

8. The image forming apparatus according to claim 1, wherein the types of operation control information include missing pixel operation control information that is obtained by evaluating a degree of variation of lines in the detection pattern.

9. The image forming apparatus according to claim 1, wherein the types of operation control information include pinhole operation control information that is obtained by identifying an absence of transitions from low to high in values output from the detection pattern position detecting unit.

10. The image forming apparatus according to claim 1, wherein the types of operation control information include wormhole operation control information that is obtained by counting a number of occurrences of transitions from low to high in values output from the detection pattern position detecting unit.

11. The image forming apparatus according to claim 1, wherein the types of operation control information include hat image operation control information that is obtained by evaluating a frequency of transitions from low to high in values output from the detection pattern position detecting unit.

12. An image forming apparatus comprising:

a detection pattern position detecting unit that detects a position of a detection pattern formed directly on an image carrier, and outputs position detection data, the image carrier being a conveyor member that carries a recording paper onto which toner images are transferred;

an acquiring unit that acquires a plurality of types of operation control information of the image forming apparatus from the position detection data, the operation control information including data of an abnormal detection pattern that occurs in the position detection pattern formed on the image carrier in response to a deterioration of a toner in the image forming apparatus or a deterioration of a specific component of the image forming apparatus that is specified by a type of the abnormal detection pattern;

an index value calculating unit that calculates an index value indicating a state of the image forming apparatus based on acquired operation control information, the index value calculating unit counts a number of peaks in the position detection data to determine the index value; and an abnormality judging unit that judges whether an abnormality has occurred in the image forming apparatus or predicts an occurrence of a failure that requires a maintenance of the image forming apparatus due to the deterioration of the toner or the deterioration of the specific component based on calculated index value.

* * * * *